US007187356B2

(12) United States Patent
Koyama et al.

(10) Patent No.: US 7,187,356 B2
(45) Date of Patent: Mar. 6, 2007

(54) DRIVER CIRCUIT OF A DISPLAY DEVICE

(75) Inventors: Jun Koyama, Kanagawa (JP); Yoshifumi Tanada, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 297 days.

(21) Appl. No.: 10/878,162

(22) Filed: Jun. 29, 2004

(65) Prior Publication Data

US 2004/0233231 A1 Nov. 25, 2004

Related U.S. Application Data

(63) Continuation of application No. 09/911,807, filed on Jul. 25, 2001, now Pat. No. 6,760,005.

(30) Foreign Application Priority Data

Jul. 25, 2000 (JP) ..... 2000-224479

(51) Int. Cl.
*G09G 3/36* (2006.01)

(52) U.S. Cl. ..... 345/98; 345/100

(58) Field of Classification Search ..... 345/98, 345/100

See application file for complete search history.

(56) References Cited

U.S. PATENT DOCUMENTS 5,559,526 A 9/1996 Izawa
5,953,003 A 9/1999 Kwon et al.
6,111,557 A 8/2000 Koyama et al.
6,278,131 B1 8/2001 Yamazaki et al.
6,344,843 B1 2/2002 Koyama et al.
6,580,411 B1 6/2003 Kubota et al.
6,593,592 B1 7/2003 Yamazaki et al.
6,597,349 B1 7/2003 Koyama et al.

OTHER PUBLICATIONS

Y. Kubota et al.; "Late-News Paper: Low-Voltage Interface Technology for CGS TFT-LCD with Low Power Consumption"; *SID 99 Digest*; pp. 1116-1119; 1999.

R.L. Melcher et al.; "Invited Paper: High-Information-Content Projection Display Based on Reflective LC on Silicon Light Valves"; *SID 98 Digest*; pp. 25-28; 1998.

*Primary Examiner*—Richard Hjerpe
*Assistant Examiner*—Kevin M. Nguyen
(74) *Attorney, Agent, or Firm*—Fish & Richardson P.C.

(57) ABSTRACT

In a driver circuit of a display device handling a digital image signal, there is provided a driver circuit with a structure in which the timing of holding the image signal in a latch circuit is not influenced by a delay of a sampling pulse. A pre-charge TFT (102) is turned ON in a return line period and an input terminal of a holding portion (101) is set as Hi (VDD). When there is input to all the three signals, the sampling pulse, and a multiplex signal and the digital image signal which are input from the outside, TFTs (104 to 106) all turn ON, and the potential of the input terminal of the holding portion (101) becomes a Lo potential. Thus, holding of the digital image signal is performed. A sampling pulse width is wider than a pulse width of the two signals input from the outside, and the output periods of the two signals input from the outside are completely included in an output period of the sampling pulse. Thus, even if a slight delay is generated, there is no influence on the holding timing, and the holding timing may be easily determined.

75 Claims, 22 Drawing Sheets

1901
1 Second 1
2
3
4
59
60
1902

Ta1
Ts1
Ta2
Ts2
Ta3
Ts3
Ta4
Ts4
1903
1904
1905
1906

001
002
003
004
479
480

001
002
003
004
639
640
1908
1907

DRIVER CIRCUIT OF A DISPLAY DEVICE

CROSS-REFERENCE TO RELATED APPLICATIONS

This application is a continuation application of U.S. application Ser. No. 09/911,807, filed on Jul. 25, 2001 now U.S. Pat. No. 6,760,005, now allowed, which claims the benefit of a foreign priority application filed in Japan on Jul. 25, 2000, as Ser. No. 2000-224479. This application claims priority to both of these applications, and both of these applications are incorporated by reference.

BACKGROUND OF THE INVENTION

1. Field of the Invention

The present invention relates to a driver circuit of a semiconductor display device (hereinafter referred to as display device), and to a display device using the driver circuit. More particularly, the present invention relates to a driver circuit of an active matrix display device having a thin film transistor (hereinafter referred to as TFT) formed on an insulator, and to an active matrix display device using the driver circuit. Of those, in particular, the present invention relates to a driver circuit of an active matrix display device input with a digital image signal and an active matrix display device using the driver circuit.

2. Description of the Related Art

Recently, the use of a display device in which a semiconductor thin film is formed on an insulator, in particular, a glass substrate, especially an active matrix display device using TFTs, is spreading. The active matrix display device using TFTs has several hundred thousands to several millions of TFTs arranged in matrix, and display of images is performed by controlling the charge of respective pixels.

Further, as a recent technique, in addition to a pixel TFT structuring a pixel, a technique relating to a polysilicon TFT where a driver circuit is simultaneously formed by using a TFT in the peripheral portion of a pixel portion is progressing.

Further, the driver circuit simultaneously formed here does not end in that deals with an analog image signal, but the driver circuit which deals with a digital image signal is realized.

A schematic diagram of a display device of a normal digital image signal input method is shown in FIG. 11. A pixel portion 1108 is arranged in the center. On the upper side of the pixel portion is arranged a source signal line driver circuit 1101 for controlling a source signal line. The source signal line driver circuit 1101 comprises a first latch circuit 1104, a second latch circuit 1105, a D/A converter circuit 1106, an analog switch 1107, and the like. On the left and right of the pixel portion, gate signal line driver circuits 1102 are arranged to control gate signal lines. Note that, in FIG. 11, the gate signal line driver circuits 1102 are arranged on both the left and right side of the pixel portion, but the circuit may be arranged on only one side. However, arrangement on both sides is more preferable from the point of view of driving efficiency and driving reliability.

The source signal line driver circuit 1101 is structured as shown in FIG. 12. This driver circuit is a source signal line driver circuit of the display device having a horizontal resolution of 1024 pixels and a 4 bit gray scale display capacity, and comprises a shift register circuit 1201 (SR), a first latch circuit 1202 (LAT1), a second latch circuit 1203 (LAT2), a D/A converter circuit 1204, and the like. Note that, FIG. 12 does not show the analog switch 1107 in FIG. 11. Further, a buffer circuit, a level shifter circuit or the like may be additionally arranged if necessary.

Further, throughout this specification, when specifically showing the circuit to sequentially output sampling pulses, it is written together as the shift register circuit, but in the present invention, the sampling pulse is not necessarily limited to be output by the shift register circuit.

The operations of the circuit is simply explained with reference to FIGS. 11 and 12. First, the shift register circuit 1201 is input with a clock signal (CLK), a clock inverted signal (CLKb) and a start pulse (S-SP), and the sampling pulses are sequentially output. The first latch circuit 1202 holds the respective digital image signals (digital data), with the input of the sampling pulses. In FIG. 12, since a 4 bit digital image signal is handled, in order to simultaneously hold data of each bit from the least significant bit to the most significant bit, the four first latch circuits operate simultaneously by the sampling pulse output from the shift register circuit of the first level. In the first latch circuits 1202, when the holding of the image signal for one horizontal period is completed, a latch signal (latch pulse) is input in a return line period, and the image signals held in the first latch circuits 1202 are all sent at once to the second latch circuits 1203.

Thereafter, a sampling pulse is again output from the first level of the shift register circuits 1201, and the holding of the image signal of the subsequent horizontal period starts. At the same time, the image signal held in the second latch circuit 1203 is input to the D/A converter circuit 1204, and converted to an analog signal. Here, the analog image signal is written in a pixel (not shown) through source signal lines (S0001 to S1024). By repeating this operation, the image is displayed.

FIG. 13 shows a portion of the source signal line driver circuit shown in FIG. 12. The sampling pulse is input to a first latch circuit 1302, a digital image signal for 1 bit is held, the holding of the digital image signal for one horizontal period is completed, and then the sampling pulse is transferred to a second latch circuit 1303 by the input of the latch signal (latch pulse). Here, the second latch circuit may have the same circuit structure as the first latch circuit.

By the way, the clock signal (CLK), the clock inverted signal (CLKb), the start pulse (S-SP), the digital image signal (digital data) and the latch signal (latch pulse) are all signals directly input from the outside, and an input at an arbitrary timing is possible. On the other hand, the timing of the pulse for holding the digital image signal depends on the timing of the sampling pulse output from a shift register circuit 1301. In order to hold the image signal normally, it is necessary that both of the timings match. However, since the sampling pulse has already passed a plurality of circuits, as shown in FIG. 2A, the sampling pulse in the timing chart shows only a delay indicated by 201. At first, the digital image signal is input in accordance with the sampling pulse of the timing chart, and therefore, in this state, the image signal may not be normally held. In this case, a slight adjustment of input timing of the digital image signal becomes necessary in accordance with the output of the actual pulse where delay has occurred.

Further, this delay time changes by variation of TFT characteristics structuring the circuit or the like, and thus, there are cases where it differs for each display apparatus. Therefore, every time there is a need for slight adjustments for each display apparatus.

In addition, with recent rapid high resolution and high precision of LCDs, the driving frequency of the whole driver circuit is getting higher. Therefore, in a case where only a slight delay occurs, there may be a case where the holding operation of the digital image signal may not be performed normally.

SUMMARY OF THE INVENTION

The present invention has been made in view of the above problems, and it is one of objects of the present invention to provide a driver circuit with a structure in which a sampling pulse delay does not influence the holding operation of a digital image signal.

In order to solve the above described objects, the following measures are taken in the present invention.

In the conventional example of the driver circuit shown in FIGS. 11 to 13, it is necessary to perform a slight adjustment of input timing of a digital image signal in accordance with the delay time of the sampling pulse. Further, since there is a variation for each display apparatus of the delay time, the slight adjustment had to be performed for each display apparatus.

Contrary to this, in the driver circuit of the present invention, a method in which the holding timing of a first latch circuit is directly determined by the signal input from the outside is taken, and the slight delay of the sampling pulse is made not to not influence the holding timing. In other words, even if there is a variation for each display apparatus, by inputting the holding timing signal and the digital image signal at the same time from the outside, both are always input to the circuit at predetermined timings, and a holding operation is always performed normally. Further, since the timing is not slightly adjusted in accordance with the delay of the circuit as conventionally, and the timing is matched and input in advance in the input stage of the plurality of signals, the adjustment becomes considerably easier.

Hereinbelow, a structure of the driver circuit of the display apparatus of the present invention will be described.

A driver circuit of a display device according to a first aspect of the present invention is characterized in that:

the driver circuit comprises:

a holding circuit performing holding of a digital image signal which is input;

a pre-charge circuit provided between a signal input portion of the holding circuit and a first power supply; and a holding operation selection circuit provided between the signal input portion of the holding circuit and a digital image signal line, and that:

the pre-charge circuit is input with a pre-charge signal; and the holding operation selection circuit is input with a sampling pulse, a multiplex signal, and a digital image signal.

A driver circuit of a display device according to a second aspect of the present invention is characterized in that:

the driver circuit comprises:

a holding circuit performing holding of a digital image signal which is input;

a pre-charge circuit provided between a signal input portion of the holding circuit and a first power supply; and a holding operation selection circuit provided between the signal input portion of the holding circuit and a digital image signal line, and that:

the pre-charge circuit is input with a pre-charge signal;

the holding operation selection circuit is input with a sampling pulse, a multiplex signal and a digital image signal;

the pre-charge circuit, by the input of the pre-charge signal, makes the signal input portion of the holding portion and the first power supply in continuity; and in the holding operation selection circuit, holding of the digital image signal is performed in the holding circuit, in a period where the input of the sampling pulse, the multiplex signal and the digital image signal overlap.

A driver circuit of a display device according to a third aspect of the present invention is characterized in that:

the driver circuit comprises:

a holding circuit performing holding of a digital image signal which is input;

a first transistor provided between a first power supply and a signal input portion of the holding circuit; and second, third and fourth transistors provided serially between a second power supply and the signal input portion of the holding circuit, and that:

a gate electrode of the first transistor is input with a pre-charge signal;

a gate electrode of the second transistor is input with a multiplex signal;

a gate electrode of the third transistor is input with a digital image signal; and a gate electrode of the fourth transistor is input with a sampling pulse.

A driver circuit of a display device according to a fourth aspect of the present invention is characterized in that:

the driver circuit comprises:

a holding circuit performing holding of a digital image signal which is input;

a first transistor provided between a first power supply and a signal input portion of the holding circuit;

second, third and fourth transistors provided serially between a second power supply and the signal input portion of the holding circuit, and that:

a gate electrode of the first transistor is input with a pre-charge signal;

the gate electrode of the second transistor is input with a multiplex signal;

the gate electrode of the third transistor is input with a digital image signal;

the gate electrode of the fourth transistor is input with a sampling pulse; and the holding circuit performs holding of the digital image signal in a period where the input of the multiplex signal, the digital image signal and the sampling pulse overlap.

A driver circuit of a display device according to a fifth aspect of the present invention, in the third or fourth aspect of the invention, is characterized in that:

the first transistor is in continuity by the input of the pre-charge signal, and a potential of the signal input portion of the holding circuit takes a first power supply potential;

the multiplex signal and the digital image signal are input during the period that the sampling pulse is output, the second to fourth transistors are in continuity, and the potential in the signal input portion of the holding circuit changes to a second power supply potential; and thereafter, until the next return line period, the second power supply potential is held in the holding circuit.

A driver circuit of a display device according to a sixth aspect of the present invention is characterized in that:

the driver circuit comprises:

a holding circuit performing holding of a digital image signal which is input;

first and second transistors arranged in parallel between a first power supply and a signal input portion of the holding circuit; and third, fourth and fifth transistors arranged serially between a second power supply and the signal input portion of the holding circuit, and that:

a gate electrode of the first transistor is input with a pre-charge signal;

a gate electrode of the second transistor is applied with a second power supply potential;

a gate electrode of the third transistor is input with a multiplex signal;

a gate electrode of the fourth transistor is input with a digital image signal; and a gate electrode of the fifth transistor is input with a sampling pulse.

A driver circuit of a display device according to a seventh aspect of the present invention is characterized in that:

the driver circuit comprises:

a holding circuit performing holding of a digital image signal which is input;

first and second transistors arranged in parallel between a first power supply and a signal input portion of the holding circuit; and third, fourth and fifth transistors arranged serially between a second power supply and the signal input portion of the holding circuit, and that:

a gate electrode of the first transistor is input with a pre-charge signal;

a gate electrode of the second transistor is applied with a second power supply potential;

a gate electrode of the third transistor is input with a multiplex signal;

a gate electrode of the fourth transistor is input with a digital image signal;

a gate electrode of the fifth transistor is input with a sampling pulse; and a holding circuit performs holding of the digital image signal in a period where the input of the multiplex signal, the digital image signal and the sampling pulse overlap.

A driver circuit of a display device according to an eighth aspect of the present invention, in the sixth or seventh aspect of the invention, is characterized in that:

the first transistor is in continuity by the input of the pre-charge signal, the potential in the signal input portion of the holding circuit takes a first power supply potential;

the multiplex signal and the digital image signal are input during the period that the sampling pulse is output, the third to fifth transistors are in continuity, and the potential in the signal input portion of the holding circuit changes to the second power supply potential; and thereafter, until the next return line period, the second power supply potential is held in the holding circuit.

A driver circuit of a display device according to a ninth aspect of the present invention is characterized in that:

the driver circuit comprises:

a holding circuit performing holding of a digital image signal which is input;

a NAND circuit; and an analog switch, and that:

the NAND circuit is input with a sampling pulse and a multiplex signal;

the holding circuit is input with a digital image signal through the analog switch;

the continuity and non-continuity of the analog switch is controlled by an output of the NAND circuit:

a write in of the image signal to the holding circuit is performed, with the continuity of the analog switch; and thereafter, until the next return line period, the image signal is held in the holding circuit.

A driver circuit of a display device according to a tenth aspect of the present invention, in any one of the first to ninth aspects of the invention, is characterized in that the multiplex signal and the digital image signal are both directly input from the outside.

A driver circuit of a display device according to an eleventh aspect of the present invention, in any one of the first to tenth aspects of the invention, is characterized in that a pulse width of the digital image signal and the pulse width of the multiplex signal are both smaller than the pulse width of the sampling pulse.

A driver circuit of a display device according to a twelfth aspect of the present invention, in any one of the first to eleventh aspects of the invention, is characterized in that the holding of the potential in the holding circuit is performed by the holding circuit formed of two inverters provided in a loop shape.

A driver circuit of a display device according to a thirteenth aspect of the present invention, in any one of the first to eleventh aspects of the invention, is characterized in that the holding of the potential in the holding circuit is performed by a holding capacity.

According to a display device of a fourteenth aspect of the present invention, the display device characterized by using the driver circuit of the display device according to any one of the first to thirteenth aspects of the invention may be provided.

DETAILED DESCRIPTION OF THE PREFERRED EMBODIMENTS

Embodiment Mode 1

Figure 22:
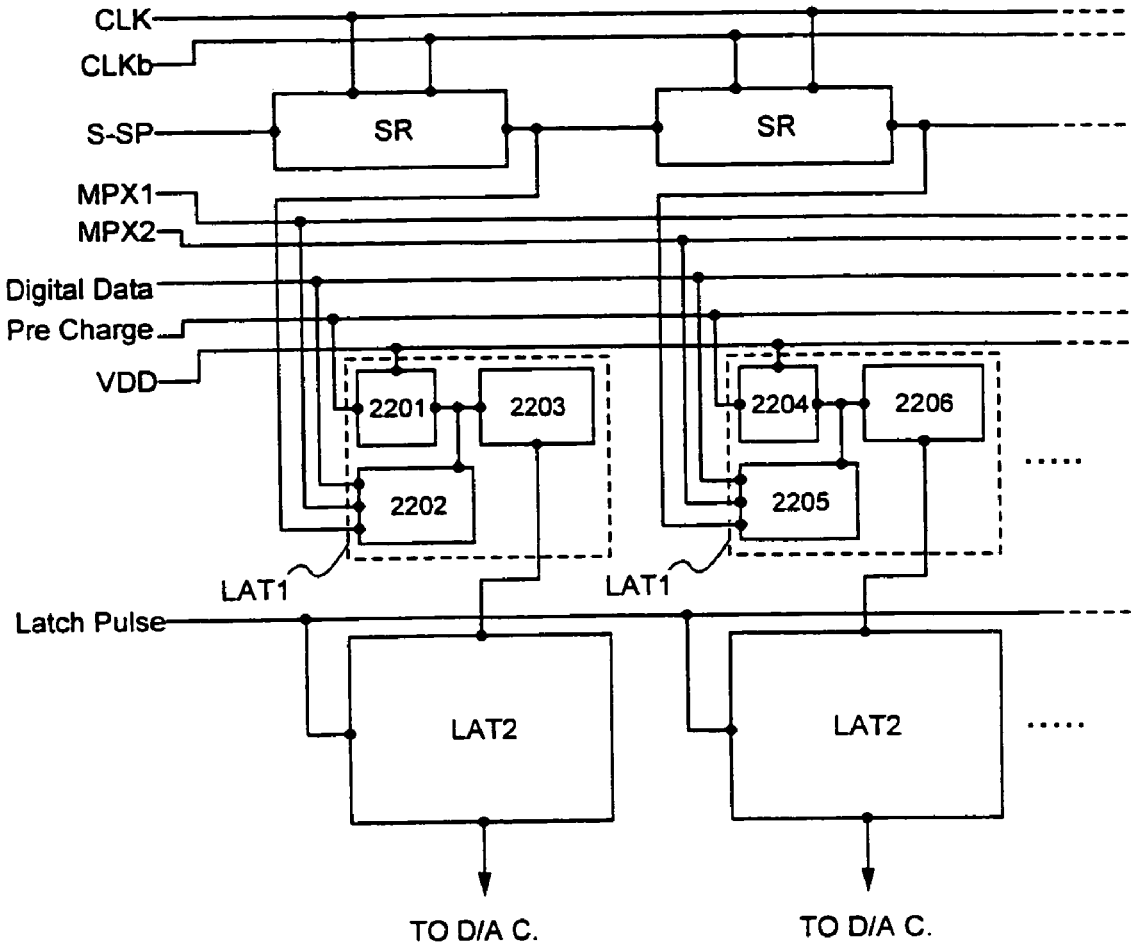
FIG. 22 shows a structural example of the peripheral circuits including the latch circuit of the present invention.

FIG. 22 shows one embodiment mode of the present invention. FIG. 22 shows a portion corresponding to shift registers (SR), first latch circuits (LAT1) and second latch circuits (LAT2) shown as two stages. The first latch circuit (LAT1) in the first stage comprises a pre-charge circuit 2201, a holding operation selection circuit 2202 and a holding circuit 2203, and the output of the holding circuit 2203 is input to the second latch circuit (LAT2). The first latch circuit (LAT1) in the first stage comprises a pre-charge circuit 2204, a holding operation selection circuit 2205 and a holding circuit 2206, and the output of the holding circuit 2206 is similarly input to the second latch circuit (LAT2).

The operation of the circuit is described. Here, a first power supply potential is taken as VDD and a second power supply potential is taken as VSS. First, in a certain return line period, by inputting a pre-charge signal, the pre-charge circuits 2201 and 2204 operate, and the electric potential of signal input portions of the holding circuits 2203 and 2206 is taken as VDD. Subsequently, the return line period is completed, and the sampling pulse from the shift register in the first stage is output, and input to the holding operation selection circuit 2202. Further, the holding operation selection circuit 2202 is further input with a multiplex signal 1 (MPX1) and a digital image signal (digital data).

In the holding operation selection circuit, in a period where a sampling pulse, a multiplex signal and a digital image signal are all input, the write in of a digital image signal to the holding circuit 2203 is allowed. In the holding circuit 2203, the digital image signal written in here is held until the horizontal period ends.

Next, a similar process is performed in the second stage. At this time, the holding operation selection circuit is input with the sampling pulse, a multiplex signal 2 (MPX2) and the digital image signal (digital data). That is, in the first stage, the third stage, the fifth stage, . . . , and the (2m−1) stage, the multiplex signal 1 (MPX1) is used, and in the second stage, the fourth stage, the sixth stage, . . . , and the (2m) stage, the multiplex signal 2 (MPX2) is used.

Subsequently, the latch signal (latch pulse) is input in the return line period, and the signal held in the holding portions 2203 and 2206 of the first latch circuit is transferred to the second latch circuit all at once. Thereafter, the operations of D/A conversion, write in the pixel and the like are in accordance with the operations described in the conventional example.

Embodiment Mode 2

In the circuit shown in Embodiment Mode 1, the figure including the detailed structure of the pre-charge circuit 2201, the holding operation selection circuit 2202 and the holding circuit 2203 is shown in FIG. 1. FIG. 1 shows only a one stage corresponding to the shift register, the first latch circuit and the second latch circuit.

Figure 1A:
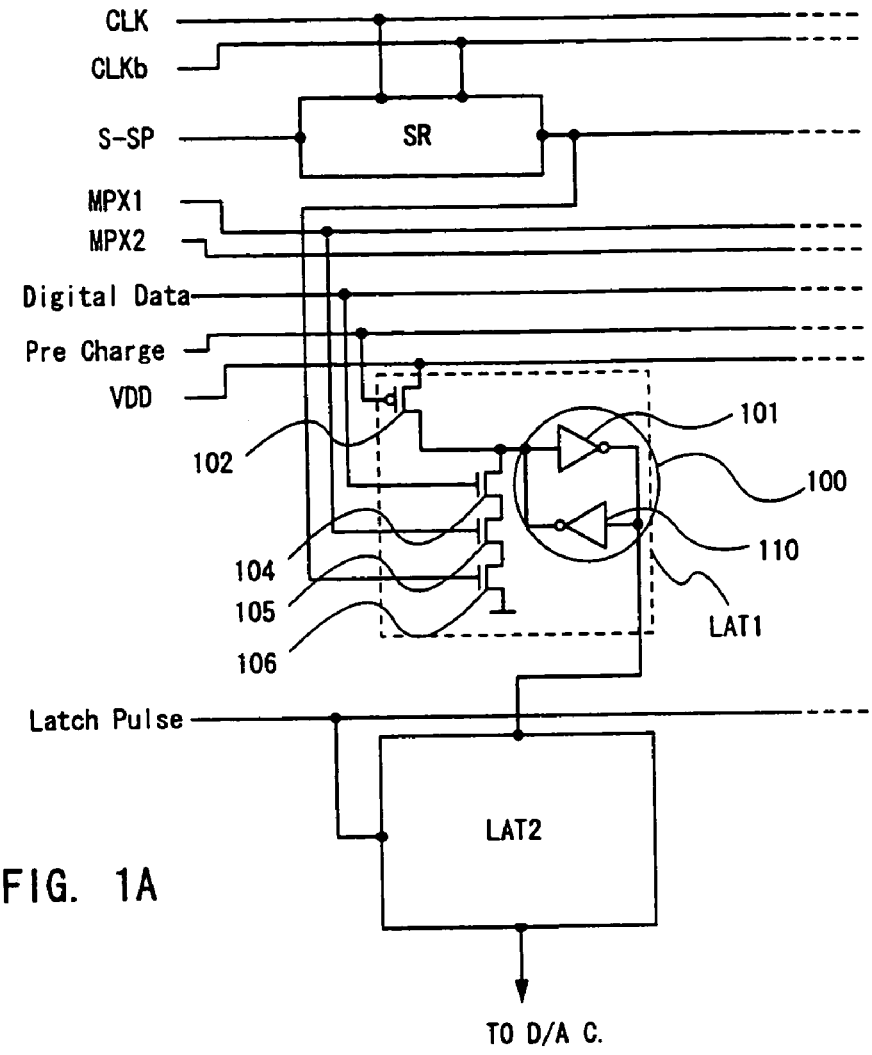
FIGS. 1A and 1B are diagrams of a structural example of peripheral circuits including a latch circuit of the present invention.
Figure 1B:
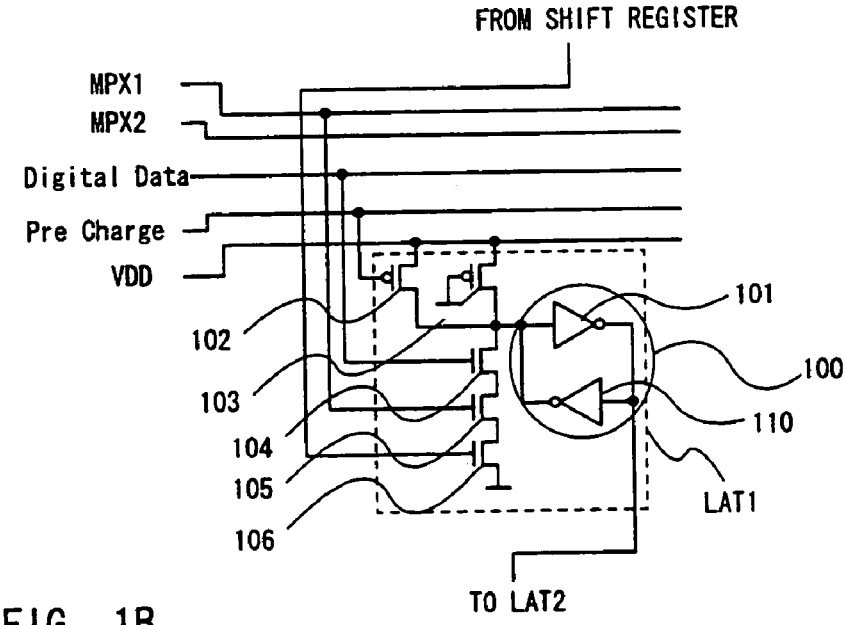

The circuit shown in FIGS. 1A and 1B comprises an image signal holding portion 100, a first TFT 102 for pre-charge (hereinafter, referred to as pre-charge TFT), a second TFT 104, a third TFT 105 and a fourth TFT 106. In FIG. 1A, a p-channel type is used for the first TFT, and an n-channel type is used for the second to fourth TFTs. Here, the TFT 102 corresponds to the pre-charge circuit 2201 in FIG. 22, and the circuit comprised of the TFTs 104, 105 and 106 corresponds to the holding operation selection circuit 2202 in FIG. 22.

The holding circuit 100 is structured by comprising two inverters. Reference numeral 101 indicates a driver inverter, reference numeral 110 indicates a holding inverter, and both are connected so as to form a loop. In a case where input to the driver inverter 101 is inconstant, output of the driver inverter 101 is fixed by the output of the holding inverter 110.

A source region of the TFT 102 is connected to a first power supply potential (here, VDD), and a drain region is connected to the input terminal of the holding portion 100. The TFTs 104 to 106 are serially arranged between a second power supply potential (here, GND) and the input terminal of the holding portion 100, and respective gate electrodes are input with multiplex signals (MPX1, MPX2), a digital image signal (digital data) and a sampling pulse, respectively. The gate electrode of the pre-charge TFT 102 is input with a pre-charge signal (pre-charge).

The operation of the first latch circuit shown in FIG. 1A is described. Note that, the potentials used here are VDD on the high potential side (referred to as Hi potential) and GND on the low potential side (referred to as Lo potential) in accordance with the amplitude of the signal. Further, as long as there is no special explanation, it is to be understood that there was a signal input at the time of Hi potential (VDD) in relation to the sampling pulse and the multiplex signal.

First, during a certain return line period, Lo is input to the pre-charge signal. Due to this, the pre-charge TFT 102 becomes in continuity, and the potential at the input terminal of the holding portion 100 is pulled up to the Hi potential (VDD). Thereafter, the pre-charge signal when entering the horizontal period becomes Hi, and the pre-charge TFT 102 returns to a non-continuity state.

Next, the operation in the horizontal period is described. The shift register circuit operates, the sampling pulse is output, and Hi is input to the gate electrode of the -channel TFT 106. During a period that this pulse is a state of Hi, the multiplex signal (MPX1) and the digital image signal (digital data) are respectively input to the gate electrodes of the -channel TFTs 104 and 105. When the three signals, the output pulse, the multiplex signal and the digital image signal from the shift register are all Hi, the n-channel TFTs 104 to 106 are all in continuity, and the Lo potential (GND) is input to the input terminal of the holding portion 100. Once it becomes the Lo potential (GND), even when the state between the n-channel TFTs 104 to 106 returns to a non-continuity, the potential is held by the holding portion 100 until the start of the next return line period.

At this time, the Hi potential at the input terminal of the holding portion 100 needs to be maintained as is until the holding operation of the digital image signal starts. Therefore, as shown in FIG. 1B, the holding of the potential may be guaranteed by adding the TFT 103 for constant current supply. A p-channel type is used here for the a constant current TFT 103, and Lo (GND) is made to always be input to the gate electrode. However, it is preferable to design the constant current TFT 103 such that the current capacity is satisfactorily small in respect to the current capacity of the TFT structuring the holding portion 100 in order not to inhibit the holding of the digital image signal.

Subsequently, a latch signal (latch pulse) is input during the return line period, and the signals held in the first latch circuit holding portion 100 are all transferred to the second latch circuit at once. Thereafter, the operations of D/A conversion, write in the pixel, and the like are in accordance with the operation as described in the conventional example.

Figure 2A:
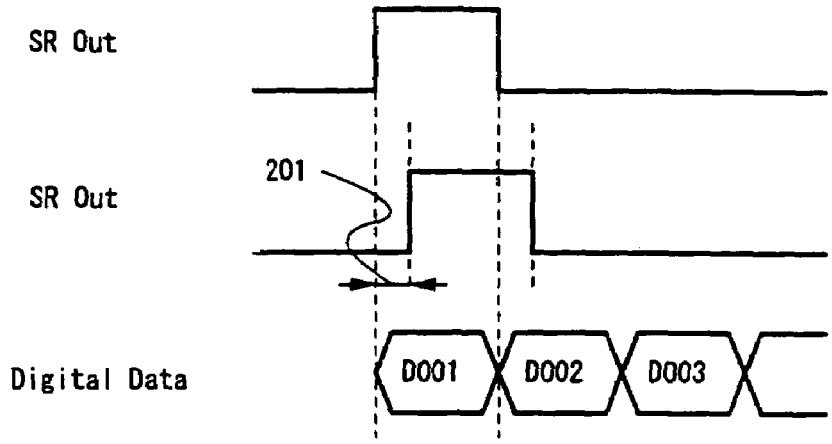
FIGS. 2A and 2B are diagrams comparing the relationships of input of a digital image signal and delay of a pulse holding the digital image signal in the conventional example and the example of the present invention.
Figure 2B:
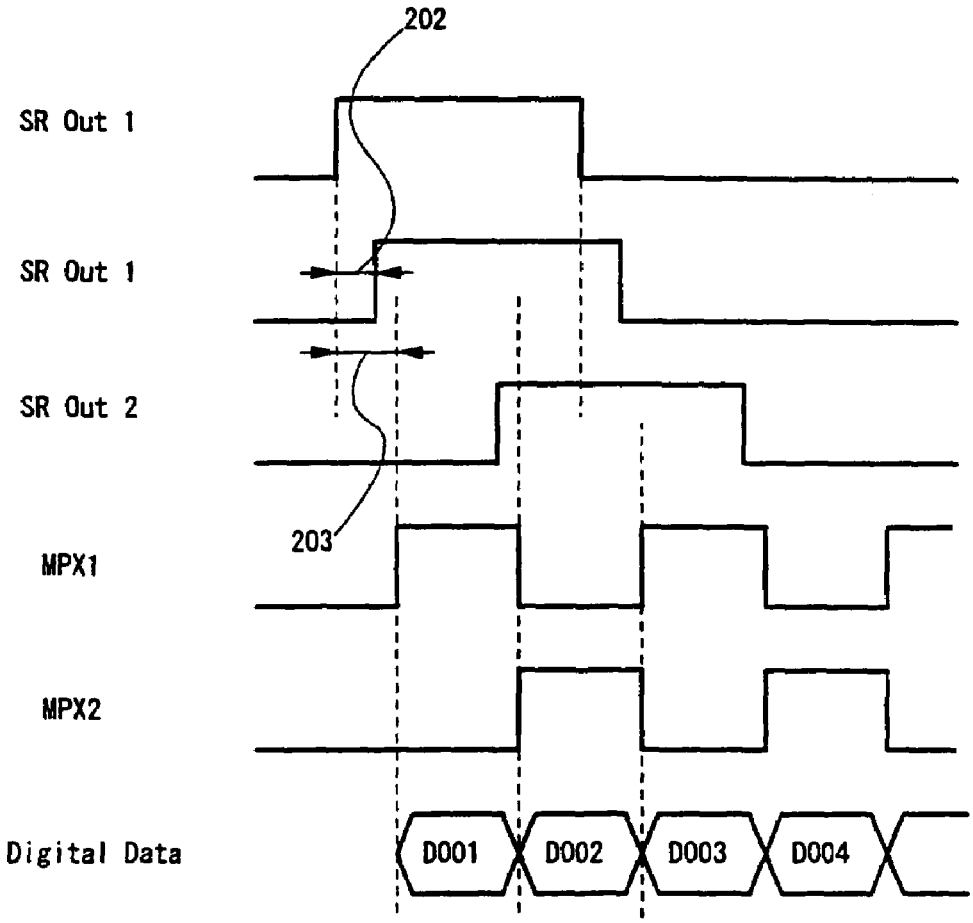

FIG. 2B shows the operation of the shift register circuit according to the driver circuit of the present invention, and the timing of the input and the holding operation of the digital image signal. In the latch circuit of the present invention, the driving frequency of the shift register circuit is half that of the conventional circuit shown in FIG. 2A, and the pulse width is widened to twice. The pulse shown as SR Out1 is, for example, a sampling pulse output from the shift register circuit of the first stage, and the pulse shown as SR Out2 is the sampling pulse output from the shift register circuit of the next stage. The actual sampling pulse generates a delay shown by 202 in respect to the sampling pulse in the timing chart.

Here, in the conventional example, since the holding operation timing in the first latch circuit was dependent on the timing of the sampling pulse, as shown in FIG. 2A, when there was a delay, the digital image signal could not be normally held. Therefore, a slight adjustment of the timing of input of the digital image signal was necessary each time.

On the other hand, as can be seen from the above description of the operation and FIG. 2, the holding operation timing in the latch circuit of the present invention is determined by the three signals, sampling pulse (SR Out#), a multiplex signal (MPX#) and a digital image signal (digital data). Then, since the other signals excluding the sampling pulse are all directly input from the outside, it can be said that the timing of the actual holding operation in the latch circuit is determined by the input timing of the multiplex signal and the digital image signal. Namely, even in a case where a slight delay is generated in the output of the sampling pulse, the timing of the holding operation does not change (in the case of FIG. 2B, delay is allowed for only the length shown by reference numeral 203).

Further, since the timing of the multiplex signal and the digital image signal which are input from the outside may be easily matched, adjustment is substantially easier compared with the conventional latch circuit.

In the structure of the latch circuit of the present invention shown in FIG. 1 of this embodiment mode, the polarities of the TFTs 102 to 106 structuring respective portions depend on the positive and negative of the sampling pulse, the pre-charge signal, the digital image signal, the multiplex signal and the like (whether each pulse is output at Hi potential, or output at Lo potential). Even in case of a TFT with different polarity from that in this example, the operational principle does not change.

By using such a latch circuit, a driver circuit which does not need slight adjustment of timing due to a delay of a signal output from the circuit, which has been a problem around the conventional latch circuit, may be provided. In addition, since the driving frequency of the shift register circuit is ½, improvement of reliability may be expected.

Further, the signals input to the first latch circuit (digital image signal, multiplex signal, sampling pulse) may only have a voltage amplitude in which the TFTs 104 to 106 are certainly in continuity. Therefore, even if the voltage amplitude is smaller than that of the voltage between VDD and GND which is a power supply connected to the latch circuit, a satisfactory normal operation is possible as long as the above conditions are satisfied. Thus, a low power consumption due to reduction of the amplitude of the input signal may be expected.

Further, the driver circuit having the latch circuit of the present invention may be applied to a display device such as a liquid crystal display device using a liquid crystal element in a pixel portion (LCD: liquid crystal display, or the like), or an EL display device using an electroluminescence (EL) element (OLED: organic EL display, or the like) as long as the display device is for operating a digital image signal.

EMBODIMENTS

One of objects of the present invention is to provide a driver circuit of a display device in which the timing of holding a digital image signal is not dependent on the delay of the sampling pulse, and the holding timing is easily controllable from the outside. In addition to the example shown in the embodiment mode, there are various application examples of the present invention. The embodiments are explained below.

Embodiment 1

Figure 3:
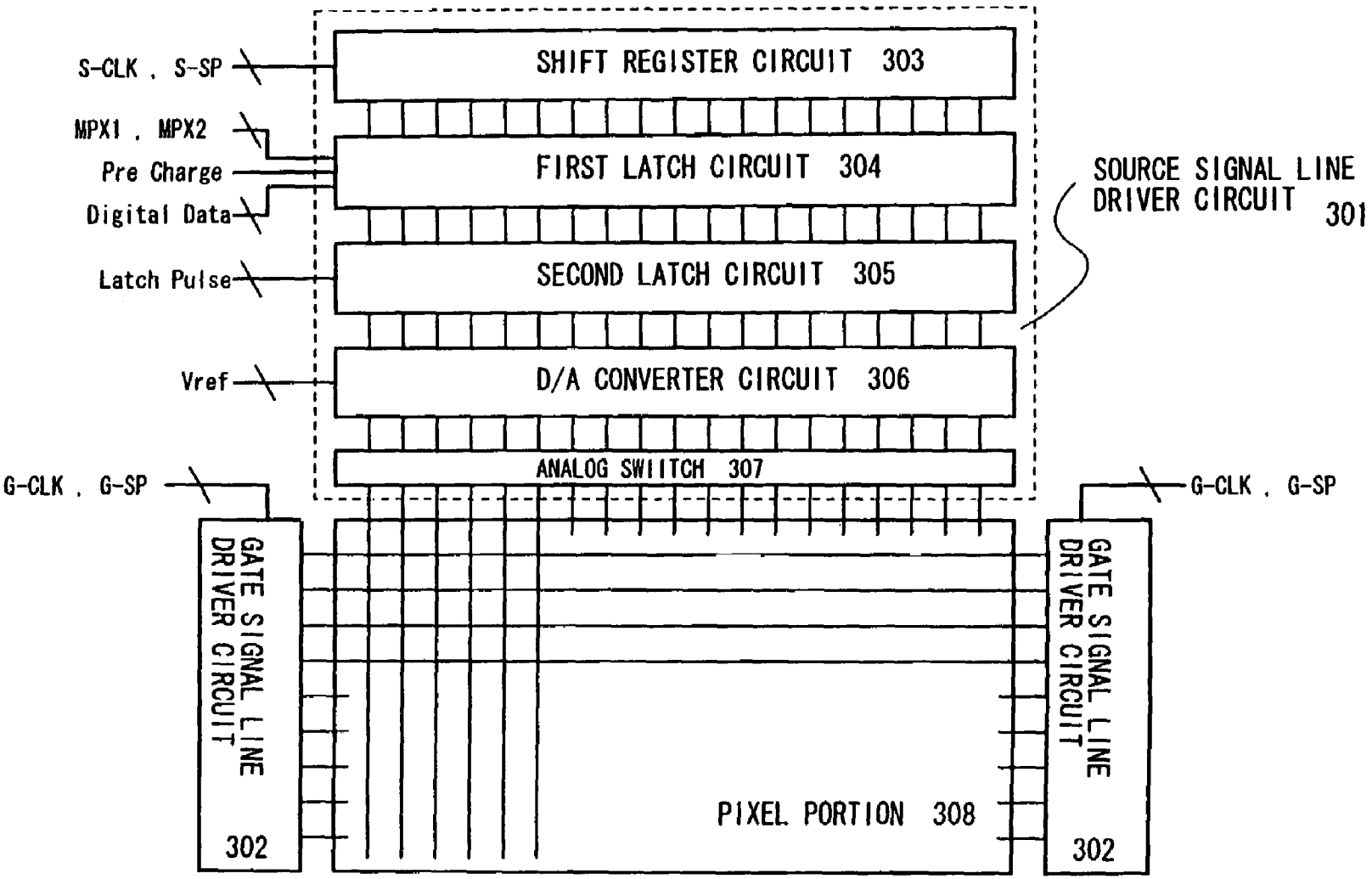
FIG. 3 is a schematic view of the entire display device in a case the display device is structured using the latch circuit of the present invention.

FIG. 3 is a schematic view of a display device using a driver circuit having a latch circuit of the present invention. A pixel portion 308 is arranged in the center. On the upper side of the pixel portion is arranged a source signal line driver circuit 301 for controlling a source signal line. The source signal line driver circuit 301 comprises a first latch circuit 304, a second latch circuit 305, a D/A converting circuit 306, an analog switch 307, and the like. The first latch circuit 304 has the structure as shown in FIG. 1. The other component parts are the same as in the conventional example. On the left and right of the pixel portion, gate signal line driver circuits 302 for controlling a gate signal line are arranged. Note that, in FIG. 3, the gate signal line driver circuits 302 are arranged on both the left and right sides of the pixel portion, but the driver circuit may be arranged on only one side. However, the arrangement on both sides is more preferable from the point of view of driving efficiency and driving reliability.

Figure 4:
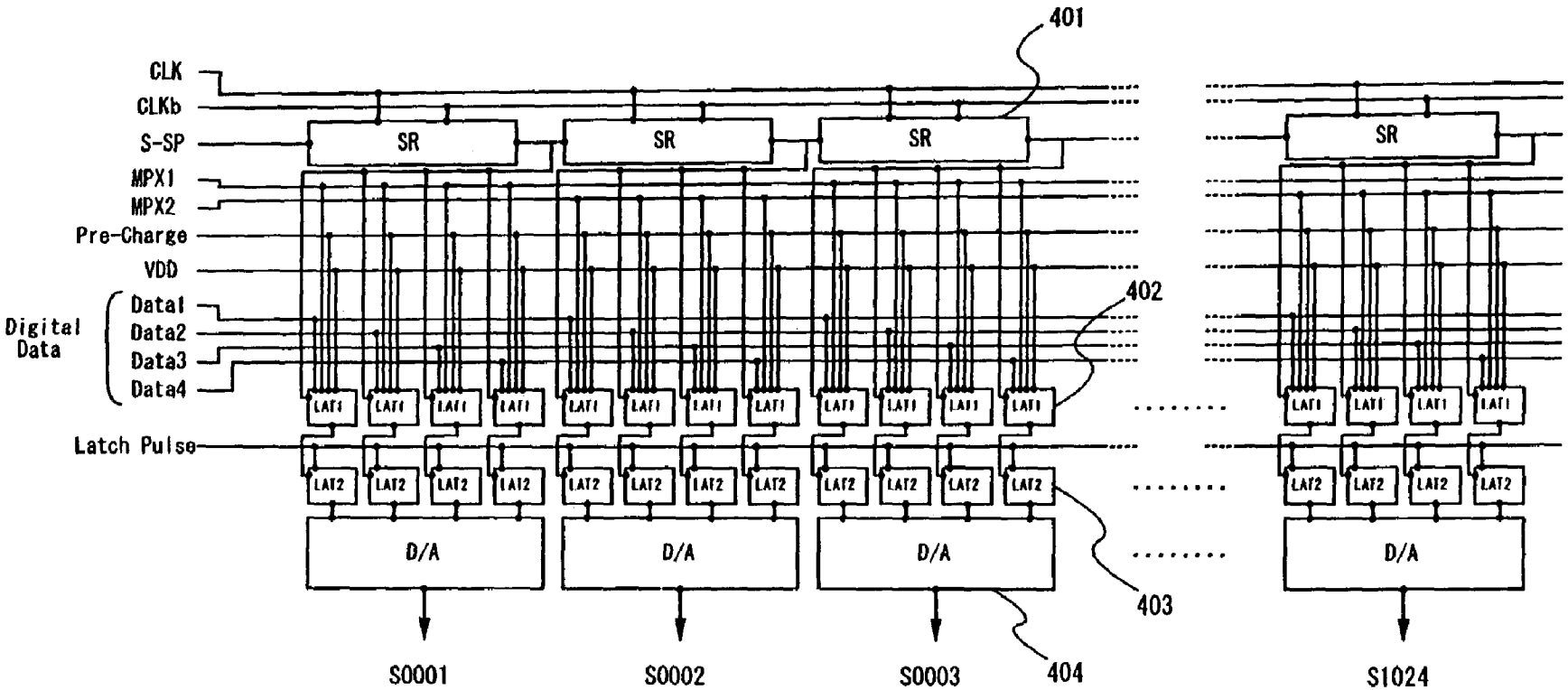
FIG. 4 is a diagram of a circuit structural example of a source signal line driver circuit of the display device shown in FIG. 3.

The source signal line driver circuit 301 has the structure as shown in FIG. 4. This driver circuit is a source signal line driver circuit of a display device having a horizontal resolution 1024 pixel, and a 4 bit gray-scale display capacity, and comprises a shift register circuit 401 (SR), a first latch circuit 402 (LAT1), a second latch circuit 403 (LAT2), a D/A conversion circuit 404 (D/A), and the like. Note that, in FIG. 4, the analog switch 307 shown in FIG. 3 is not shown.

Further, if necessary, a buffer circuit, a level shifter circuit, or the like may be additionally arranged.

The first latch circuit 402 is input with, in addition to the sampling pulse, a pre-charge signal (pre-charge), multiplex signals (MPX1, MPX2), a digital image signal (digital data), and the like. Further, in FIG. 4, the wiring shown as VDD is not a signal line, but a power supply line supplied so the potential of the first latch circuit is increased to Hi during the return line period.

The multiplex signals (MPX1, MPX2) use the signal input to MPX1 to determine the holding timing of the odd numbered stage of the first latch circuit (in FIG. 4, the first latch circuit which holds the image signal written in the source signal lines $S_{0001}$, $S_{0003}$, . . . $S_{2n-1}$), and use the signal input to MPX2 to determine the holding timing of the even numbered stage of the first latch circuit (in FIG. 4, the first latch circuit which holds the image signal written in the source signal lines $S_{0002}$, $S_{0004}$, . . . $S_{2n}$). Thus, overlapping of the adjacent pulses does not occur.

Embodiment 2

In the driver circuit of the present invention shown in FIG. 1, the holding portion 100 forms a loop using the driver inverter 101 and the holding inverter 110, and the signal is held using the holding inverter 110. As another method, even with the structure shown in FIG. 20, the same functions may be realized.

Figure 20:
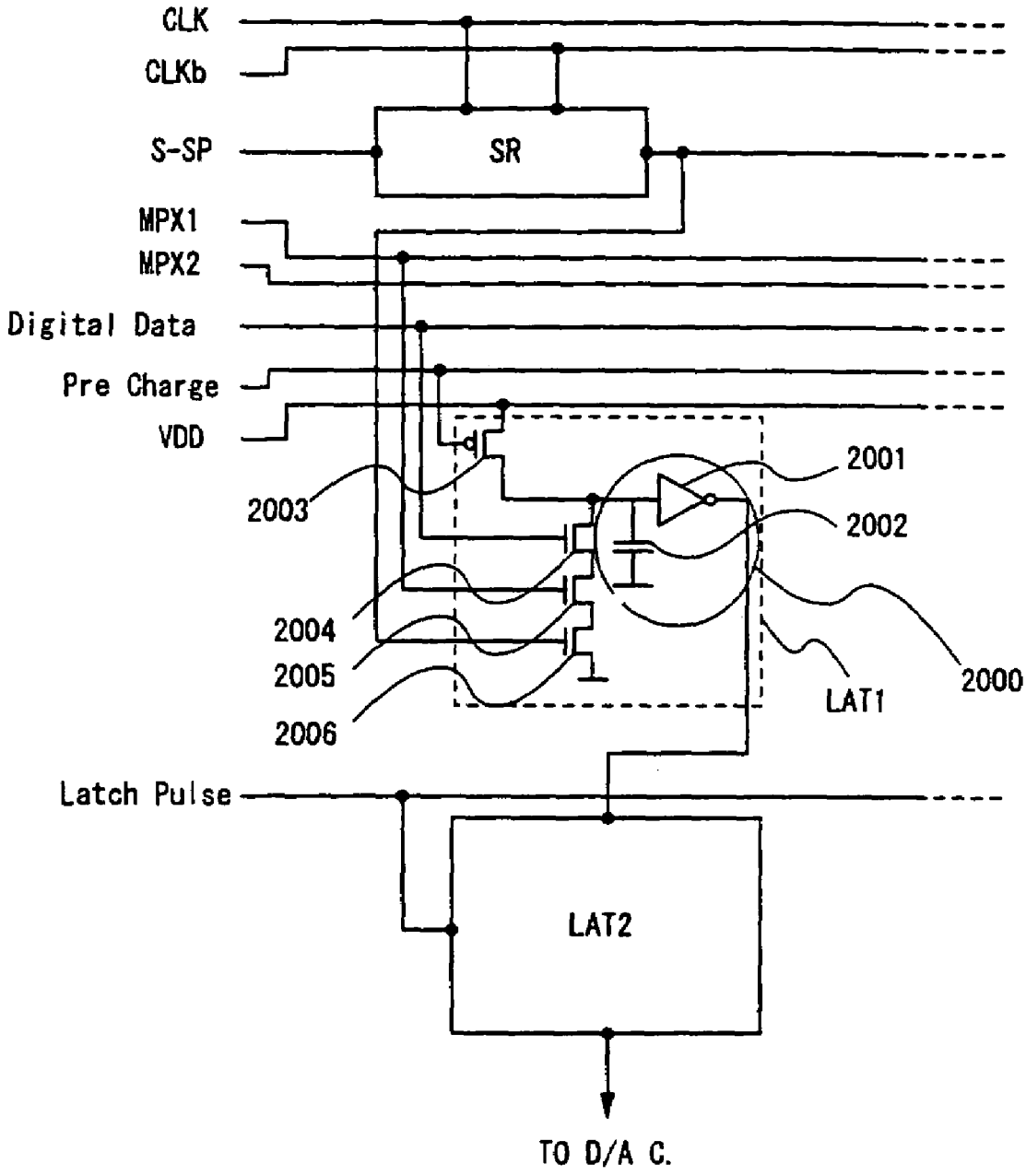
FIG. 20 shows a structural example of peripheral circuits including the latch circuit of the present invention.

A holding portion 2000 of a latch circuit shown in FIG. 20 is structured by a driver inverter 2001 and a capacity 2002. When the potential at the input terminal to the holding portion 2000 is increased to a Hi potential (VDD) by a pre-charge TFT 2003 during a return line period, and also when a Lo potential (GND) is input to the holding portion 2000 by an input of the sampling pulse, the digital image signal and the multiplex signal to hold the image signal, the capacity 2002 holds the electric charge.

The driving of the circuit and the input of signals may be the same as the circuit shown in FIG. 1.

Embodiment 3

In this embodiment, a structure and operation of a circuit in a case where a pre-charge operation in a return line period is omitted are explained.

Figure 21A:
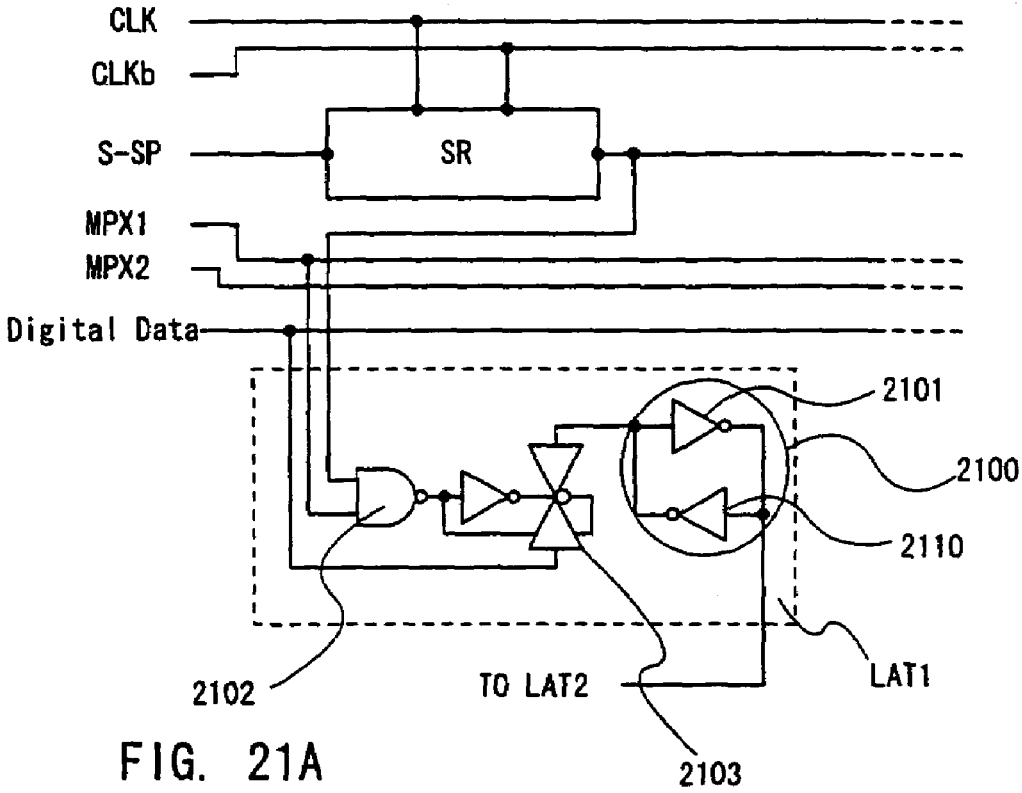
FIGS. 21A and 21B show a structural example of the peripheral circuits including the latch circuit of the present invention and the timing chart.
Figure 21B:
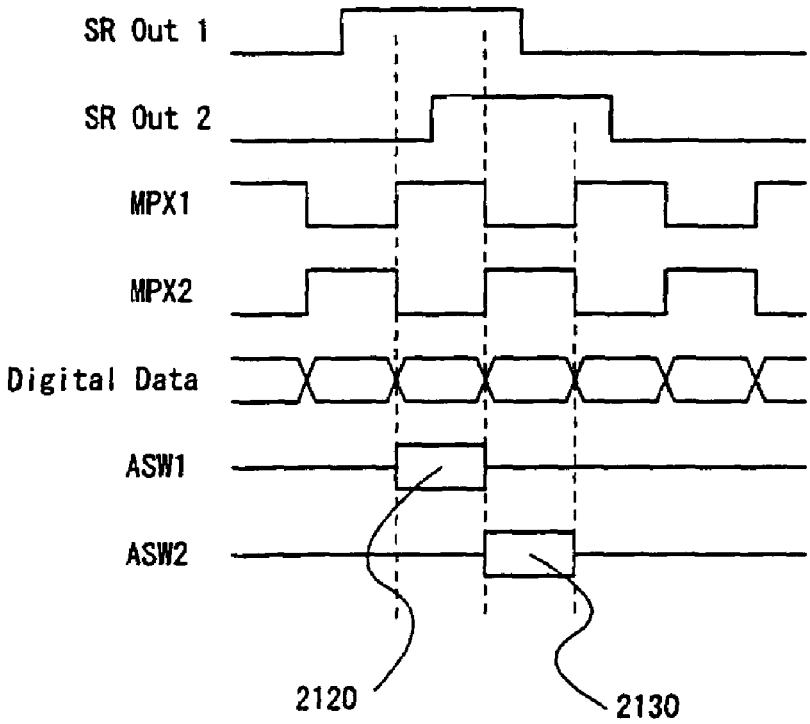

FIGS. 21A and 21B are a structural view of the circuit and the timing chart. As shown in FIG. 21A, a latch circuit of this embodiment comprises a holding portion 2100, a NAND circuit 2102 and an analog switch 2103. The NAND circuit 2102 is input with a sampling pulse and a multiplex signal, and when there is a Hi potential (VDD) input to both the two signals, a Lo potential (GND) is output. By the NAND output, the continuity or non-continuity of the analog switch 2103 is determined. Namely, when the sampling pulse and the multiplex signal are both Hi inputs, the analog switch 2103 is in continuity, and a digital image signal is input to a driver inverter 2101 of the holding portion 2100. Thereafter, when the analog switch is in a non-continuity state, the digital image signal is held until the next return line period by the holding inverter 2110 connected as a loop shape.

By the multiplex signals (MPX1, MPX2) using a signal to be input to the MPX1 to determine the holding timing of an odd numbered stage first latch circuit (in FIG. 4, the first latch circuit which performs holding of the image signal written in source signal lines $S_{0001}$, $S_{0003}$, . . . , $S_{2n-1}$), and using a signal to be input to the MPX2 to determine the holding timing of an even numbered stage first latch circuit (in FIG. 4, the first latch circuit which performs holding of the image signal written in source signal lines $S_{0002}$, $S_{0004}$, . . . , $S_{2n}$), as shown by 2120 and 2130 in FIG. 21B, the continuity timing of the adjacent analog switch 2103 is made so as not to overlap in the same period.

Further, in respect to the holding portion 2100, as described in Embodiment 2, it may be structured to use a holding capacity instead of the holding inverter 2110.

The input timing of each signal may be the same as other embodiments. With this method, the latch circuit with the same advantages of the present invention may be provided without performing a pre-charge operation in the return line period.

Embodiment 4

Embodiment 4, a method of simultaneously manufacturing TFTs of driver circuit portions provided in the pixel portion and the periphery thereof (a source signal line driver circuit, a gate signal line driver circuit and a pixel selective signal line driver circuit). However, in order to simplify the explanation, a CMOS circuit, which is the basic circuit for the driver circuit, is shown in the figures.

Figures 5A, 5B, 5C:
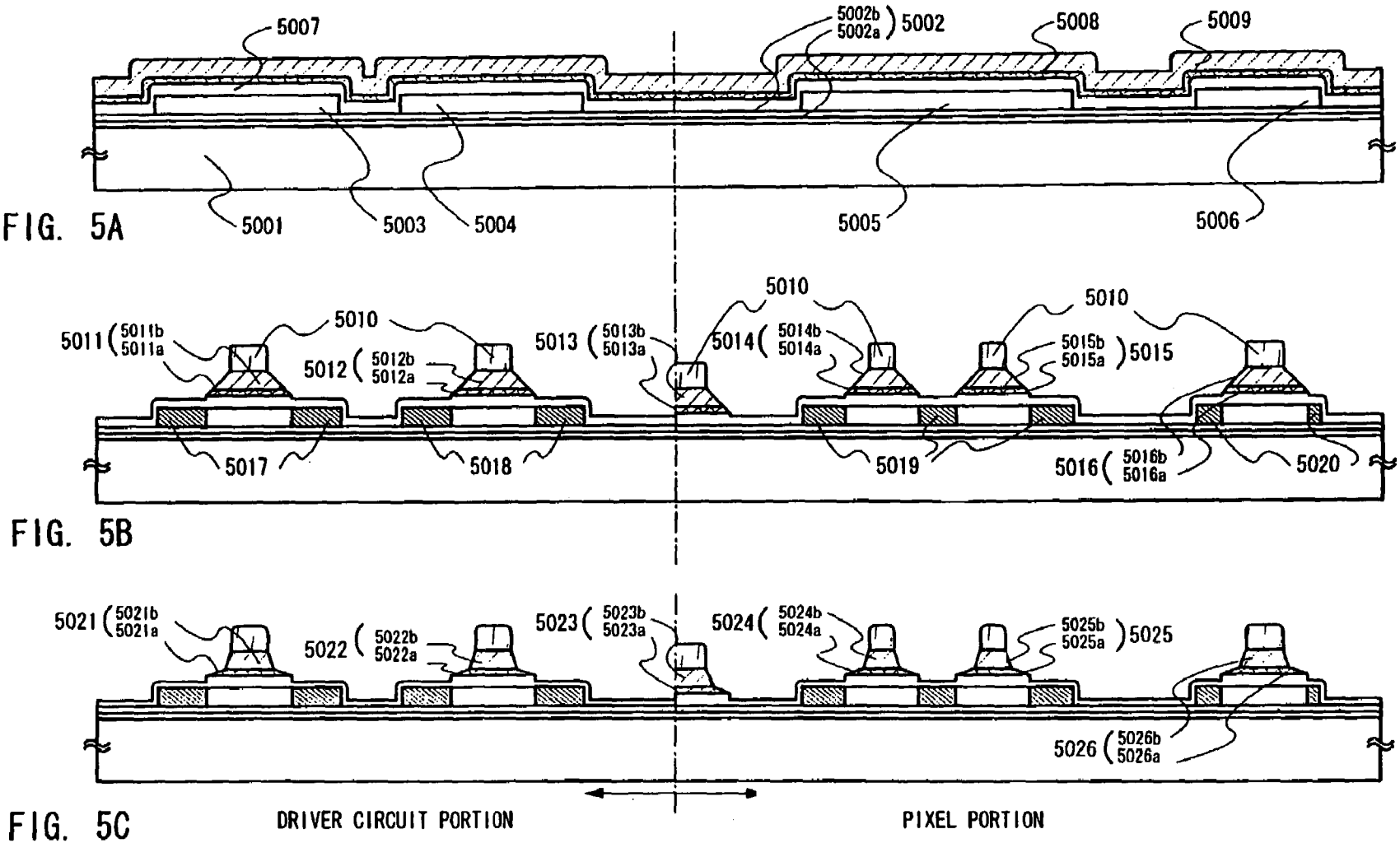
FIGS. 5A to 5C are diagrams of an example of a manufacturing process of a liquid crystal display device.

First, as shown in FIG. 5A, a base film 5002 made of an insulating film such as a silicon oxide film, a silicon nitride film, or a silicon nitride oxide film is formed on a substrate 5001 made of glass such as barium borosilicate glass or alumino borosilicate glass, typified by #7059 glass or #1737 glass of Coming Inc. For example, a silicon nitride oxide film 5002*a* fabricated from $SiH_4$, $NH_3$ and $N_2O$ by a plasma CVD method is formed with a thickness of 10 to 200 nm (preferably 50 to 100 nm), and a hydrogenated silicon nitride oxide film 5002*b* similarly fabricated from $SiH_4$ and $N_2O$ is formed with a thickness of 50 to 200 nm (preferably 100 to 150 nm) to form a lamination. In Embodiment 4, although the base film 5002 is shown as the two-layer structure, the film may be formed of a single layer film of the foregoing insulating film or as a lamination structure of more than two layers.

Island-like semiconductor films 5003 to 5006 are formed of a crystalline semiconductor film manufactured by using a laser crystallization method on a semiconductor film having an amorphous structure, or by using a known thermal crystallization method. The thickness of the island-like semiconductor films 5003 to 5006 is set from 25 to 80 nm (preferably between 30 and 60 nm). There is no limitation on the crystalline semiconductor film material, but it is preferable to form the film from a silicon or a silicon germanium (SiGe) alloy.

A laser such as a pulse oscillation type or continuous emission type excimer laser, a YAG laser, or a $YVO_4$ laser is used for manufacturing the crystalline semiconductor film in the laser crystallization method. A method of condensing laser light emitted from a laser oscillator into a linear shape by an optical system and then irradiating the light to the semiconductor film may be employed when these types of lasers are used. The crystallization conditions may be suitably selected by the operator, but the pulse oscillation frequency is set to 30 Hz, and the laser energy density is set from 100 to 400 mJ/cm$^2$ (typically between 200 and 300 mJ/cm$^2$) when using the excimer laser. Further, the second harmonic is utilized when using the YAG laser, the pulse oscillation frequency is set from 1 to 10 kHz, and the laser energy density may be set from 300 to 600 mJ/cm$^2$ (typically between 350 and 500 mJ/cm$^2$). The laser light which has been condensed into a linear shape with a width of 100 to 1000 μm, for example 400 μm, is then irradiated over the entire surface of the substrate. This is performed with an overlap ratio of 80 to 98%.

Next, a gate insulating film 5007 is formed covering the island-like semiconductor films 5003 to 5006. The gate insulating film 5007 is formed of an insulating film containing silicon with a thickness of 40 to 150 nm by a plasma CVD method or a sputtering method. A 120 nm thick silicon nitride oxide film is formed in Embodiment 4. The gate insulating film is not limited to such a silicon nitride oxide film, of course, and other insulating films containing silicon may also be used, in a single layer or in a lamination structure. For example, when using a silicon oxide film, it can be formed by the plasma CVD method with a mixture of TEOS (tetraethyl orthosilicate) and $O_2$, at a reaction pressure of 40 Pa, with the substrate temperature set from 300 to 400° C., and by discharging at a high frequency (13.56 MHz) with electric power density of 0.5 to 0.8 W/cm$^2$. Good characteristics of the silicon oxide film thus manufactured as a gate insulating film can be obtained by subsequently performing thermal annealing at 400 to 500° C.

A first conductive film 5008 and a second conductive film 5009 are then formed on the gate insulating film 5007 in order to form gate electrodes. In Embodiment 4, the first conductive film 5008 is formed from Ta with a thickness of 50 to 100 nm, and the second conductive film 5009 is formed from W with a thickness of 100 to 300 nm.

The Ta film is formed by sputtering, and sputtering of a Ta target is performed by using Ar. If an appropriate amount of Xe or Kr is added to the Ar during sputtering, the internal stress of the Ta film will be relaxed, and film peeling can be prevented. The resistivity of an a phase Ta film is on the order of 20 μΩcm, and the Ta film can be used for the gate electrode, but the resistivity of a β phase Ta film is on the order of 180 μΩcm and the Ta film is unsuitable for the gate electrode. The α phase Ta film can easily be obtained if a tantalum nitride film, which possesses a crystal structure near that of α phase Ta, is formed with a thickness of 10 to 50 nm as a base for Ta in order to form the α phase Ta film.

The W film is formed by sputtering with W as a target. The W film can also be formed by a thermal CVD method using tungsten hexafluoride ($WF_6$). Whichever is used, it is necessary to make the film low resistant in order to use it as the gate electrode, and it is preferable that the resistivity of the W film be set 20 μΩcm or less. The resistivity can be lowered by enlarging the crystals of the W film, but for cases where there are many impurity elements such as oxygen within the W film, crystallization is inhibited, and the film becomes high resistant. A W target having a purity of 99.9999% is thus used in sputtering. In addition, by forming the W film while taking sufficient care such that no impurities from the inside of the gas phase are introduced at the time of film formation, a resistivity of 9 to 20 μΩcm can be achieved.

Note that although the first conductive film 5008 and the second conductive film 5009 are formed from Ta and W, respectively, in Embodiment 4, the conductive films are not limited to these. Both the first conductive film 5008 and the second conductive film 5009 may also be formed from an element selected from the group consisting of Ta, W, Ti, Mo, Al, and Cu, or from an alloy material or a chemical compound material having one of these elements as its main constituent. Further, a semiconductor film, typically a polysilicon film, into which an impurity element such as phosphorous is doped, may also be used. Examples of preferable combinations other than that in Embodiment 4 include: the first conductive film 5008 formed from tantalum nitride (TaN) and the second conductive film 5009 formed from W; the first conductive film 5008 formed from tantalum nitride (TaN) and the second conductive film 5009 formed from Al; and the first conductive film 5008 formed from tantalum nitride (TaN) and the second conductive film 5009 formed from Cu.

Next, a mask 5010 is formed from resist, and a first etching process is performed in order to form electrodes and wirings. An ICP (inductively coupled plasma) etching method is used in Embodiment 4. A gas mixture of $CF_4$ and $Cl_2$ is used as an etching gas, and a plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. The W film and the Ta film are both etched on the same order when $CF_4$ and $Cl_2$ are mixed.

Edge portions of the first conductive layer and the second conductive layer are made into a tapered shape in accordance with the effect of the bias voltage applied to the substrate side with the above etching conditions by using a suitable resist mask shape. The angle of the tapered portions is from 15 to 45°. The etching time may be increased by approximately 10 to 20% in order to perform etching without any residue on the gate insulating film. The selectivity of a silicon nitride oxide film with respect to a W film is from 2 to 4 (typically 3), and therefore approximately 20 to 50 nm of the exposed surface of the silicon nitride oxide film is etched by this over-etching process. First shape conductive layers 5011 to 5016 (first conductive layers 5011*a* to 5016*a* and second conductive layers 5011*b* to 5016*b*) are thus formed of the first conductive layer and the second conductive layer by the first etching process. At this point, regions of the gate insulating film 5007 not covered by the first shape conductive layers 5011 to 5016 are made thinner by approximately 20 to 50 nm by etching. (FIG. 5A)

Then, a first doping process is performed to add an impurity element for imparting a n-type conductivity. Doping may be carried out by an ion doping method or an ion injecting method. The condition of the ion doping method is that a dosage is $1\times10^{13}$ to $5\times10^{14}$ atoms/cm$^2$, and an acceleration voltage is 60 to 100 keV. As the impurity element for imparting the n-type conductivity, an element belonging to group 15, typically phosphorus (P) or arsenic (As) is used, but phosphorus is used here. In this case, the conductive layers 5011 to 5016 become masks to the impurity element to impart the n-type conductivity, and first impurity regions 5017 to 5020 are formed in a self-aligning manner. The impurity element to impart the n-type conductivity in the concentration range of $1\times10^{20}$ to $1\times10^{21}$ atoms/cm$^3$ is added to the first impurity regions 5017 to 5020. (FIG. 5B) Next, as shown in FIG. 5C, a second etching process is performed without removing the resist mask. The etching gas of the mixture of $CF_4$, $Cl_2$ and $O_2$ is used, and the W film is selectively etched. At this point, second shape conductive layers 5021 to 5026 (first conductive layers 5021*a* to 5026*a* and second conductive layers 5021*b* to 5026*b*) are formed by the second etching process. Regions of the gate insulating film 5007, which are not covered with the second shape conductive layers 5021 to 5026 are made thinner by about 20 to 50 nm by etching.

An etching reaction of the W film or the Ta film by the mixture gas of $CF_4$ and $Cl_2$ can be guessed from a generated radical or ion species and the vapor pressure of a reaction product. When the vapor pressures of fluoride and chloride of W and Ta are compared with each other, the vapor pressure of $WF_6$ of fluoride of W is extremely high, and other $WCl_5$, $TaF_5$, and $TaCl_5$ have almost equal vapor pressures. Thus, in the mixture gas of $CF_4$ and $Cl_2$, both the W film and the Ta film are etched. However, when a suitable amount of $O_2$ is added to this mixture gas, $CF_4$ and $O_2$ react with each other to form CO and F, and a large number of F radicals or F ions are generated. As a result, an etching rate of the W film having the high vapor pressure of fluoride is increased. On the other hand, with respect to Ta, even if F is increased, an increase of the etching rate is relatively small. Besides, since Ta is easily oxidized as compared with W, the surface of Ta is oxidized by addition of $O_2$. Since the oxide of Ta does not react with fluorine or chlorine, the etching rate of the Ta film is further decreased. Accordingly, it becomes possible to make a difference between the etching rates of the W film and the Ta film, and it becomes possible to make the etching rate of the W film higher than that of the Ta film.

Figures 6A, 6B, 6C:
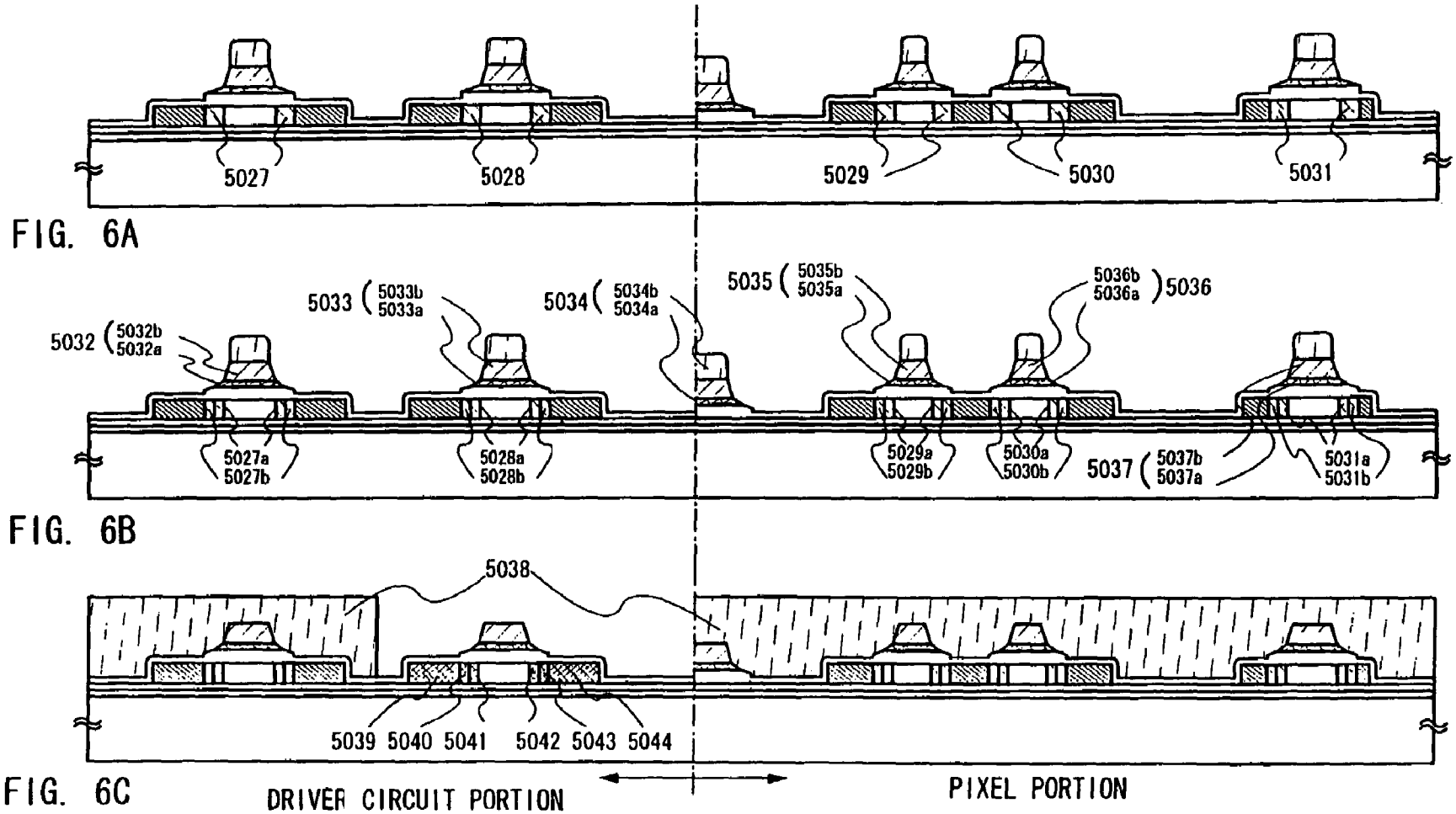
FIGS. 6A to 6C are diagrams of an example of the manufacturing process of the liquid crystal display device.

Then, as shown in FIG. 6A, a second doping process is performed. In this case, a dosage is made lower than that of the first doping process and under the condition of a high acceleration voltage, an impurity element for imparting the n-type conductivity is doped. For example, the process is carried out with an acceleration voltage set to 70 to 120 keV and at a dosage of $1\times10^{13}$ atoms/cm$^2$, so that new impurity regions are formed inside of the first impurity regions formed into the island-like semiconductor layers in FIG. 5B. Doping is carried out such that the second shape conductive layers 5021 to 5026 are used as masks to the impurity element and the impurity element is added also to the regions under the first conductive layers 5021*a* to 5026*a*. In this way, second impurity regions 5027 to 5031 are formed. The concentration of phosphorous (P) added to the second impurity regions 5027 to 5031 has a gentle concentration gradient in accordance with the thickness of tapered portions of the first conductive layers 5021*a* to 5026*a*. Note that in the semiconductor layer that overlap with the tapered portions of the first conductive layers 5021*a* to 5026*a*, the concentration of impurity element slightly falls from the end portions of the tapered portions of the first conductive layers 5021*a* to 5026*a* toward the inner portions, but the concentration keeps almost the same level.

As shown in FIG. 6B, a third etching process is performed. This is performed by using a reactive ion etching method (RIE method) with an etching gas of $CHF_6$. The tapered portions of the first conductive layers 5021*a* to 5026*a* are partially etched, and the region in which the first conductive layers overlap with the semiconductor layer is reduced by the third etching process. Third shape conductive layers 5032 to 5037 (first conductive layers 5032*a* to 5037*a* and second conductive layers 5032*b* to 5037*b*) are formed. At this point, regions of the gate insulating film 5007, which are not covered with the third shape conductive layers 5032 to 5037 are made thinner by about 20 to 50 nm by etching.

By the third etching process, in the case of second impurity regions 5027 to 5031, second impurity regions 5027*a* to 5031*a* which overlap with the first conductive layers 5032*a* to 5037*a*, and third impurity regions 5027*b* to 5231*b* between the first impurity regions and the second impurity regions.

Then, as shown in FIG. 6C, fourth impurity regions 5039 to 5044 having a conductivity type opposite to the first conductivity type are formed in the island-like semiconductor layers 5004 forming p-channel TFTs. The third conductive layers 5033*b* are used as masks to an impurity element, and the impurity regions are formed in a self-aligning manner. At this time, the whole surfaces of the island-like semiconductor layers 5003, 5005, the retention capacitor portion 5006 and the wiring portion 5034, which form n-channel TFTs are covered with a resist mask 5038. Phosphorus is added to the impurity regions 5039 to 5044 at different concentrations, respectively. The regions are formed by an ion doping method using diborane ($B_2H_6$) and the impurity concentration is made $2\times10^{20}$ to $2\times10^{21}$ atoms/cm$^3$ in any of the regions.

By the steps up to this, the impurity regions are formed in the respective island-like semiconductor layers. The third shape conductive layers 5032, 5033, 5035, and 5036 overlapping with the island-like semiconductor layers function as gate electrodes. The numeral 5034 functions as an island-like source signal line. The numeral 5037 functions as a capacitor wiring.

After the resist mask 5038 is removed, a step of activating the impurity elements added in the respective island-like semiconductor layers for the purpose of controlling the conductivity type. This step is carried out by a thermal annealing method using a furnace annealing oven. In addition, a laser annealing method or a rapid thermal annealing method (RTA method) can be applied. The thermal annealing method is performed in a nitrogen atmosphere having an oxygen concentration of 1 ppm or less, preferably 0.1 ppm or less and at 400 to 700° C., typically 500 to 600° C. In Embodiment 4, a heat treatment is conducted at 500° C. for 4 hours. However, in the case where a wiring material used for the third conductive layers 5037 to 5042 is weak to heat, it is preferable that the activation is performed after an interlayer insulating film (containing silicon as its main ingredient) is formed to protect the wiring line or the like.

Further, a heat treatment at 300 to 450° C. for 1 to 12 hours is conducted in an atmosphere containing hydrogen of 3 to 100%, and a step of hydrogenating the island-like semiconductor layers is conducted. This step is a step of terminating dangling bonds in the semiconductor layer by thermally excited hydrogen. As another means for hydrogenation, plasma hydrogenation (using hydrogen excited by plasma) may be carried out.

Next, a first interlayer insulating film 5045 of a silicon oxynitride film is formed with a thickness of 100 to 200 nm. Then, a second interlayer insulating film 5046 of an organic insulating material is formed thereon. After that, etching is carried out to form contact holes.

Figure 7A:
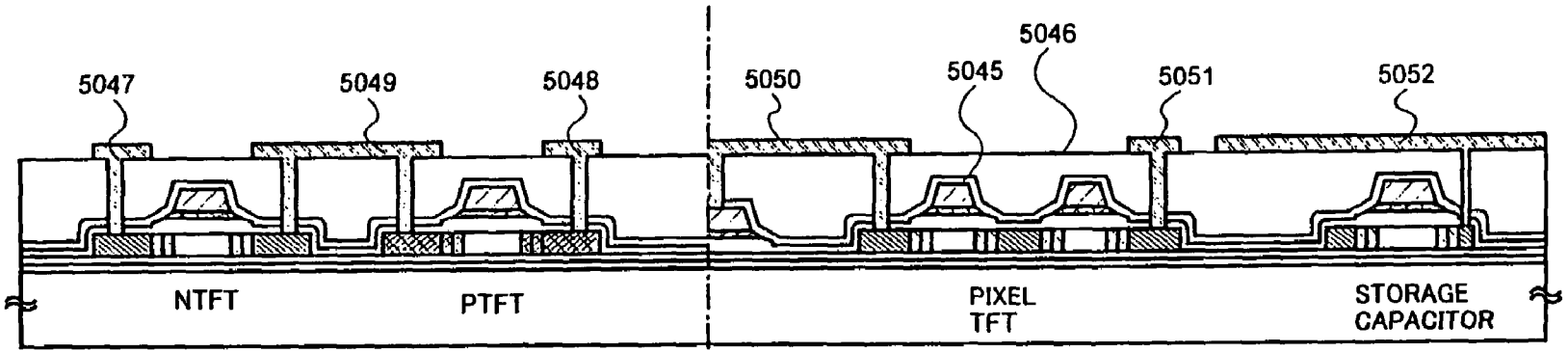
FIGS. 7A and 7B are diagrams of an example of the manufacturing process of the liquid crystal display device.

Then, in the driver circuit portion, source wirings 5047 and 5048 for contacting the source regions of the island-like semiconductor layers, and a drain wiring 5049 for contacting the drain regions of the island-like semiconductor layers are formed. In the pixel portion, a connecting electrode 5050 and pixel electrodes 5051 and 5052 are formed (FIG. 7A). The connecting electrode 5050 allows electric connection between the source signal line 5034 and pixel TFTs. It is to be noted that the pixel electrode 5052 and a storage capacitor are of an adjacent pixel.

As described above, the driver circuit portion having the n-type TFT and the p-type TFT and the pixel portion having the pixel TFT and the storage capacitor can be formed on one substrate. Such a substrate is herein referred to as an active matrix substrate.

In this embodiment, end portions of the pixel electrodes are arranged so as to overlap signal lines and scanning lines for the purpose of shielding from light spaces between the pixel electrodes without using a black matrix.

Further, according to the process described in the present embodiment, the number of photomasks necessary for manufacturing an active matrix substrate can be set to five (a pattern for the island-like semiconductor layers, a pattern for the first wirings (scanning lines, signal lines, and capacitor wirings), a mask pattern for the p-channel regions, a pattern for the contact holes, and a pattern for the second wirings (including the pixel electrodes and the connecting electrodes)). As a result, the process can be made shorter, the manufacturing cost can be lowered, and the yield can be improved.

Figure 7B:
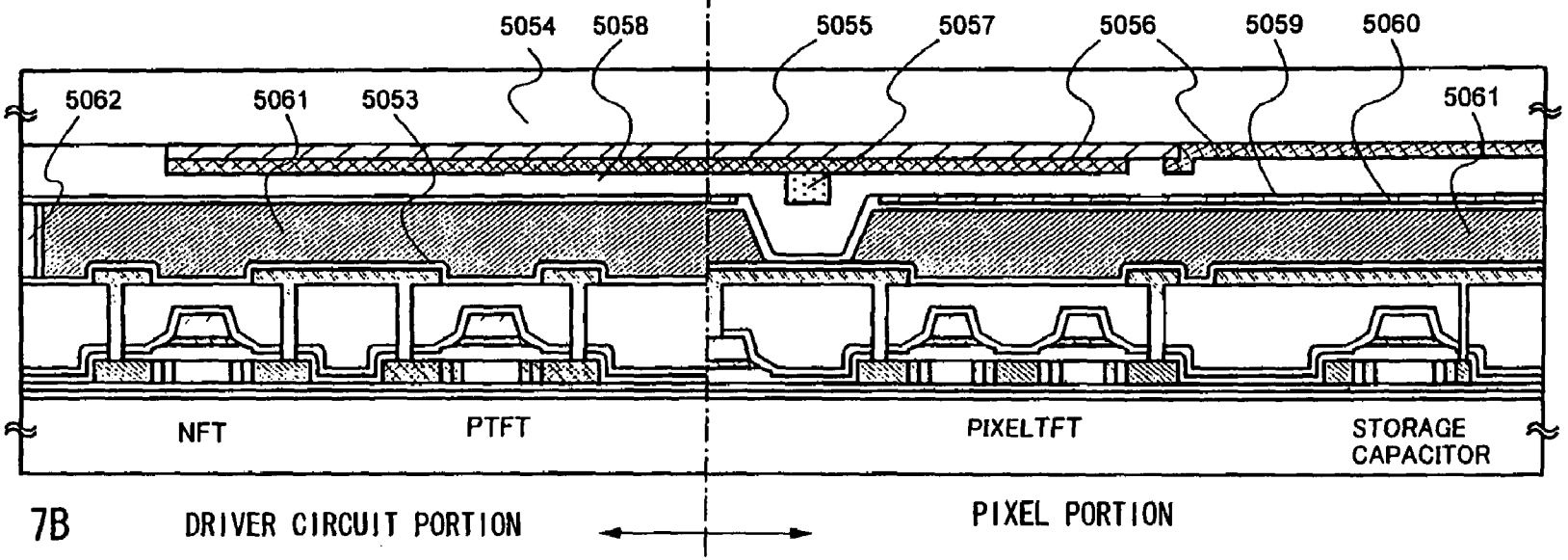

Next, after the active matrix substrate as illustrated in FIG. 7B is obtained, an orientation film 5053 is formed on the active matrix substrate and a rubbing treatment is carried out.

Meanwhile, an opposing substrate 5054 is prepared. Color filter layers 5055 to 5057 and an overcoat layer 5058 are formed on the opposing substrate 5054. The color filter layers are structured such that the red color filter layer 5055 and the blue color filter layer 5056 overlap over the TFTs so as to serve also as a light-shielding film. Since it is necessary to shield from light at least spaces among the TFTs, the connecting electrodes, and the pixel electrodes, it is preferable that the red color filter and the blue color filter are arranged so as to overlap such that these places are shielded from light.

The red color filter layer 5055, the blue color filter layer 5056, and the green color filter layer 5057 are overlapped so as to align with the connecting electrode 5050 to form a spacer. The respective color filters are formed by mixing appropriate pigments in an acrylic resin and are formed with a thickness of 1 to 3 μm. These color filters can be formed from a photosensitive material in a predetermined pattern using a mask. Taking into consideration the thickness of the overcoat layer 5058 of 1 to 4 μm, the height of the spacer can be made to be 2 to 7 μm, preferably 4 to 6 μm. This height forms a gap when the active matrix substrate and the opposing substrate are adhered to each other. The overcoat layer 5058 is formed of a photosetting or thermosetting organic resin material such as a polyimide resin or an acrylic resin.

The arrangement of the spacer may be arbitrarily determined. For example, as illustrated in FIG. 7B, the spacer may be arranged on the opposing substrate 5054 so as to align with the connecting electrode 5050. Or, the spacer may be arranged on the opposing substrate 5054 so as to align with a TFT of the driver circuit portion. Such spacers may be arranged over the whole surface of the driver circuit portion, or may be arranged so as to cover the source wirings and the drain wirings.

After the overcoat layer 5058 is formed, an opposing electrode 5059 is patterned to be formed, an orientation film 5060 is formed, and a rubbing treatment is carried out.

Then, the active matrix substrate having the pixel portion and the driver circuit portion formed thereon is adhered to the opposing substrate using a sealant 5062. Filler is mixed in the sealant 5062. The filler and the spacers help the two substrates to be adhered to each other with a constant gap therebetween. After that, a liquid crystal material 5061 is injected between the substrates, and encapsulant (not shown) carries out full encapsulation. As the liquid crystal material 5061, a known liquid crystal material may be used. In this way, an active matrix liquid crystal display device as illustrated in FIG. 7B is completed.

It is to be noted that, though the TFTs formed in the above processes are of a top gate structure, this embodiment may be easily applied to TFTs of a bottom gate structure and of other structures.

Embodiment 5

In this embodiment, a method of applying a driver circuit having a latch circuit of the present invention to an EL display device using an EL element in a pixel portion, and integrally forming the EL display device on an insulator is explained. However, in order to make the explanation simple, a CMOS circuit which is a base unit in regard to a driver circuit portion is shown in the figure.

Figure 8A:
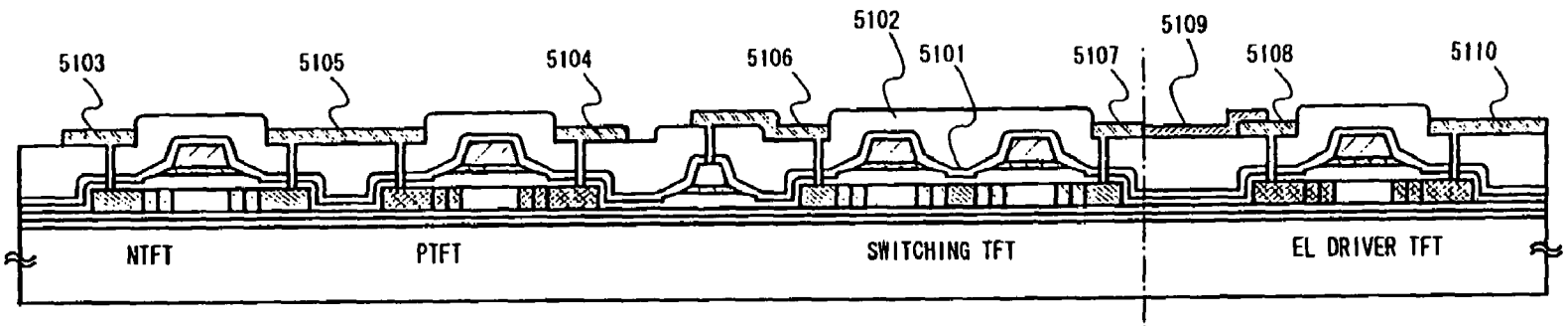
FIGS. 8A and 8B are diagrams of an example of a manufacturing process of an EL display device.

First, in accordance with Embodiment 4, the state up to FIG. 6C is manufactured. After the third doping process, a resist is peeled off and TFTs of a CMOS circuit portion and a pixel portion are completed. Note that, in Embodiment 4, the pixel TFT and the holding capacity are shown in the pixel portion. However, in this embodiment, as shown in FIG. 8A, a switching TFT and an EL driver TFT are shown in the pixel portion. However, the forming process of the TFT is the same.

As shown in FIG. 8A, a first interlayer insulating film 5101 is formed of a silicon oxide nitride film with a thickness of 100 to 200 nm. A second interlayer insulating film 5102 made of an organic insulating material is formed thereon, and then, contact holes are formed in the first interlayer insulating film 5101, the second interlayer insulating film 5102, and the gate insulating film 5007. Respective wirings (including connection wirings and signal lines) 5103 to 5108, and 5110 are formed by patterning, and then a pixel electrode 5109 contacting the connection wiring 5108 is formed by patterning.

As the second interlayer insulating film 5102, a film made of an organic resin is used, and as the organic resin, polyimide, polyamide, acrylic, BCB (benzocyclobutene), or the like may be used. In particular, since the second interlayer insulating film 5102 is mainly used for leveling, an acrylic with excellent leveling properties is preferable. In this embodiment, an acrylic film is formed with a film thickness that may satisfactorily level the step formed by the TFT. Preferably the thickness is 1 to 5 μm (more preferably 2 to 4 μm).

Contact holes are formed by dry etching or wet etching, and are each formed to reach the source region, the drain region and the gate electrode of the respective TFTs.

Further, as the wirings (including connection wirings and signal lines) 5103 to 5108, and 5110 a lamination film of a three layer structure, in which a Ti film with a thickness of 100 nm, an aluminum film containing Ti with a thickness of 300 nm, and a Ti film with a thickness of 150 nm are sequentially formed by sputtering, formed into a desired shape by patterning is used. Of course, other conductive films may also be used.

Further, in this embodiment, an ITO film is formed with a thickness of 110 nm as the pixel electrode 5109, and patterning is performed. The pixel electrode 5109 is arranged to contact and overlap the connection wiring 5108 to form a contact. Further, a transparent conductive film of indium oxide mixed with 2 to 20% of zinc oxide (ZnO) may be used. This pixel electrode 5109 becomes an anode of the EL element (FIG. 8A).

Figure 8B:
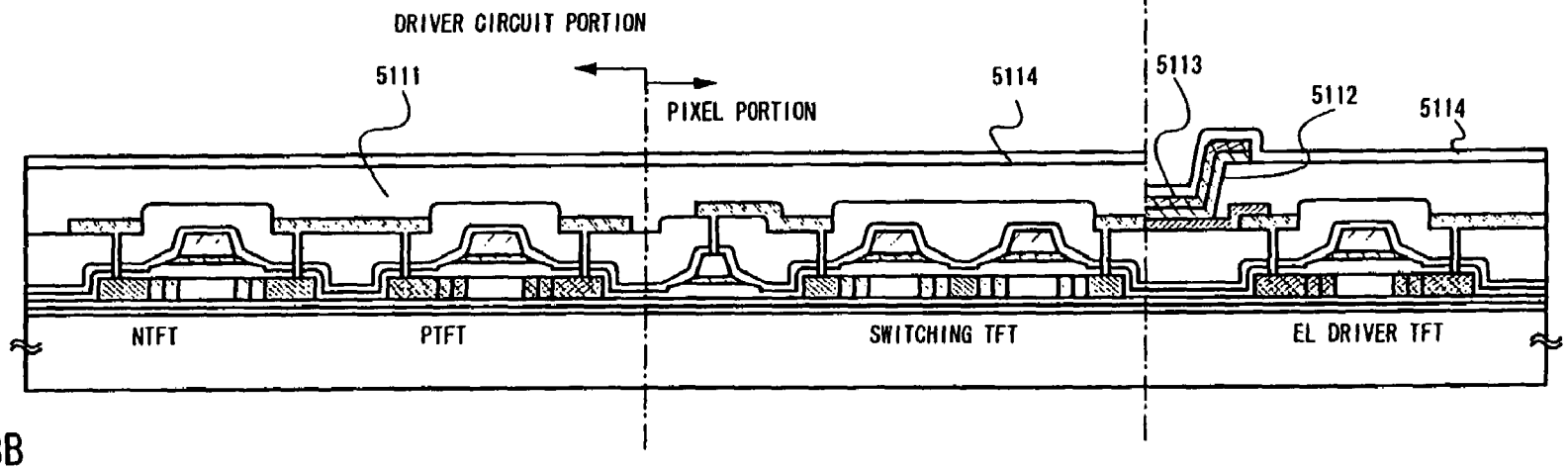

Next, as shown in FIG. 8B, an insulating film containing silicon (silicon oxide film in this embodiment) is formed with a thickness of 500 nm, an opening portion is formed in a position corresponding to the pixel electrode 5109, and a third interlayer insulating film 5111 which functions as a bank is formed. When forming the opening portion, it may easily be made as a side wall with a tapered shape by a wet etching method. If the side wall of the opening portion is not sufficiently smooth, the deterioration of the EL layer due to the step becomes a significant problem, and therefore this needs attention.

Next, an EL layer 5112 and a cathode (MgAg electrode) 5113 are sequentially formed by a vapor deposition method without exposure to the air. Note that, the film thickness of the EL layer 5112 is 80 to 200 nm (typically 100 to 120 nm), and the thickness of the cathode 5113 is 180 to 300 nm (typically 200 to 250 nm).

In this process, for a pixel corresponding to a red color, a pixel corresponding to a green color and a pixel corresponding to a blue color, EL layers and cathodes are formed sequentially. However, since the EL layer has low tolerance against solution, it has to be formed separately for each color without using a photolithography technique. Therefore, it is preferable that the EL layer and the cathode are formed selectively in only necessary parts, by using a metal mask and covering the portions other than the desired pixels.

That is, first, a mask covering everything other than the pixel corresponding to the red color is set, and a red color light emitting EL layer is selectively formed using the mask. Next, a mask covering everything other than the pixel corresponding to the green color is set, and a green color light emitting EL layer is selectively formed using the mask. Next, similarly a mask covering everything other than the pixel corresponding to the blue color is set, and a blue color light emitting EL layer is selectively formed using the mask. Note that, here it is described that all different masks are used, but the same mask may be commonly used.

Here, a method of forming three kinds of EL elements corresponding to RGB is used, but a method combining a white color light emitting EL element and a color filter, a method combining a blue or blue green color light emitting EL element and a fluophor (a fluorescent light conversion layer: CCM), a method of overlapping an EL element corresponding to RGB on a cathode (opposing electrode) using a transparent electrode, or the like may be used.

Note that, a known material may be used as the EL layer 5112. As the known material, it is preferable to use an organic material in view of the driver voltage. For example, the EL layer may be a four layer structure formed of a hole injecting layer, a hole transporting layer, a light emitting layer and an electron injecting layer.

Next, a cathode 5113 is formed using a metal mask on a pixel (a pixel on the same line) having a switching TFT connected with a gate electrode on the same gate signal line. Note that, in this embodiment MgAg is used as the cathode 5113, but the present invention is not limited thereto. Other known materials may be used as the cathode 5113.

Finally, a passivation film 5114 made of a silicon nitride film is formed with a thickness of 300 nm. By forming the passivation film 5114, the EL layer 5112 may be protected from moisture and the like, and the reliability of the EL element may be further heightened.

In this way the EL display with the structure as shown in FIG. 8B is completed. Note that, in the manufacturing process of the EL display of this embodiment, in relation to the structure and processes of the circuit, the source signal line is formed form Ta and W which are materials forming the gate electrode, and the gate signal line is formed from A1 which is a wiring material forming the source and drain electrodes. However, different materials may be used.

By the way, the EL display of this embodiment shows extremely high reliability by arranging a suitable structured TFT in not only the pixel portion but also the driver circuit portion, and operating characteristics may also be improved. Further a metal catalyst such as Ni is added in the crystallization process, and it is possible to improve crystallinity. Thus, it is possible to make the driving frequency of the source signal line driver circuit 10 MHz or more.

First, the TFT with a structure of reducing hot carrier injection so as not to drop the operation speed as much as possible is used as the n-channel TFT of the CMOS circuit forming the driver circuit portion. Note that, the driver circuit described here includes a shift register, a buffer, a level shifter, a latch in a line-sequential drive. and a transmission gate in a dot-sequential drive, and the like.

In case of this embodiment, the active layer of the n-channel TFT includes the source region, the drain region, an overlapping LDD region ($L_{ov}$ region) overlapping with the gate electrode and sandwiching the gate insulating film, an offset LDD region ($L_{OFF}$ region) not overlapping with the gate electrode and sandwiching the gate insulating film, and a channel forming region.

Further, the p-channel TFT of the CMOS circuit hardly has deterioration due to hot carrier injection, and therefore an LDD region does not have to be especially provided. Of course, it is possible to arrange an LDD region similarly as the n-channel TFT to take hot carrier countermeasures.

Also, in the driver circuit, if a CMOS circuit where a current flows two way in a channel forming region, namely, a CMOS circuit where the roles of the source region and the drain region switch is used, it is preferable that the n-channel TFT forming the CMOS circuit forms the LDD region on both sides of the channel forming region sandwiching the channel forming region. As such an example, the transmission gate used in a dot sequential drive and the like can be given. Further in the driver circuit, in a case where the CMOS circuit in which the off current needs to be suppressed to as low as possible is used, the n-channel TFT forming the CMOS circuit preferably has a $L_{ov}$ region. As such an example, likewise, are the transmission gate used in a dot-sequential drive and the like.

Note that, in actuality, when the state up to FIG. 8B is completed, it is preferable to pack (enclose) with a protecting film with high air tightness and little degassing (such as a laminate film, an ultraviolet curing resin film or the like) or a transparent sealing member, so as to avoid exposure to the outside air. In this case, the reliability of the EL element improves if the inside of the sealing member is made to be an inert atmosphere, or a hygroscopic material (for example, barium oxide) is arranged in the sealing member.

Further, when airtightness is increased by a process of packaging or the like, then a connector for connecting a terminal drawn out from an element or a circuit formed on the substrate, and an external signal terminal (flexible printed circuit: FPC) is attached, to complete the product. The state that the product may be shipped is referred to as the EL display device in this specification.

Further, according to the processes shown in this embodiment, the number of photomasks necessary for the manufacturing of the EL display device may be suppressed. As a result, the processes may be reduced, and this may contribute to the reduction of the manufacturing cost and the improvement of yield.

Embodiment 6

Figure 9:
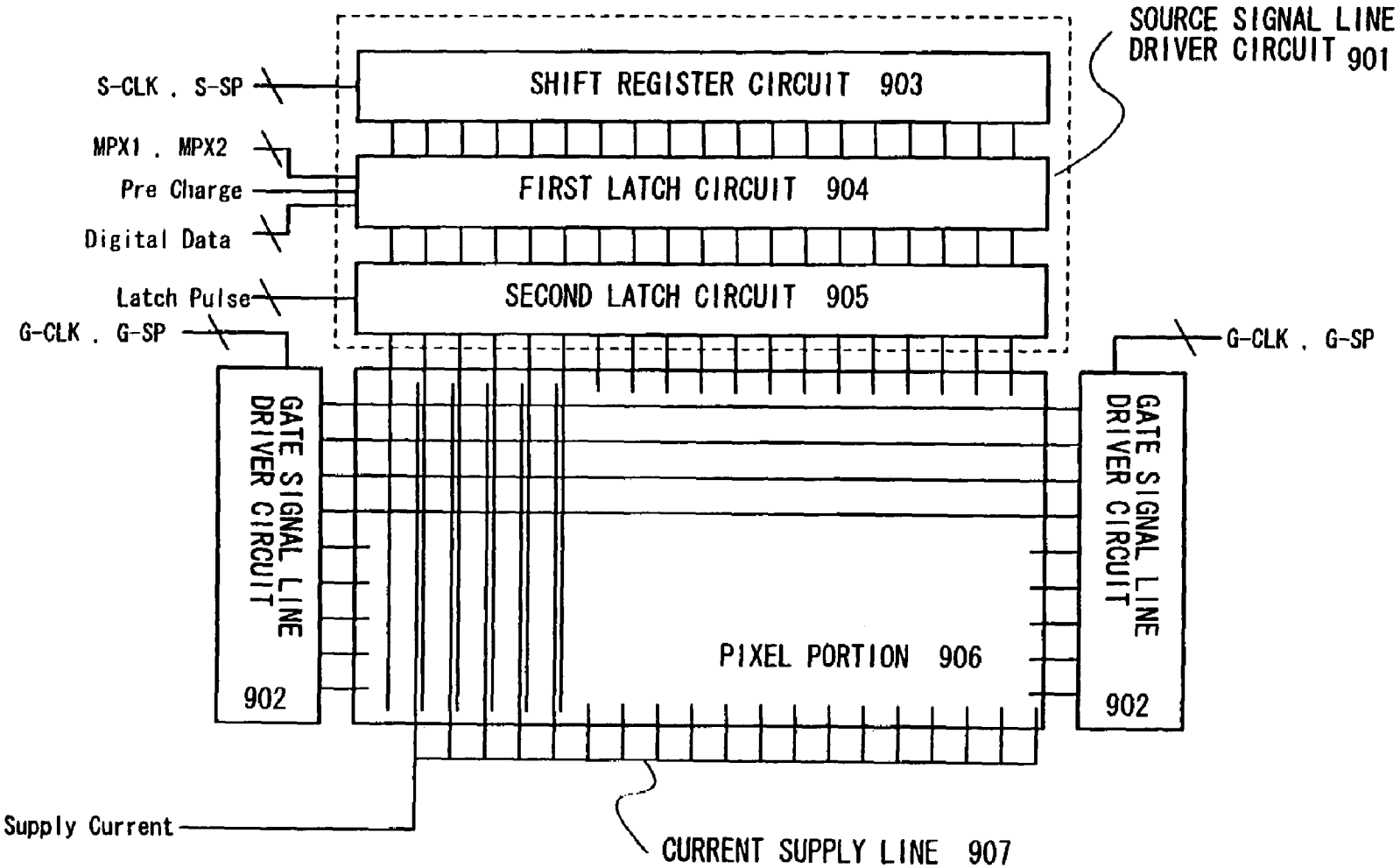
FIG. 9 is a schematic view of the entire EL display device in a case where the EL display device is structured using the latch circuit of the present invention.

A driver circuit having a latch circuit of the present invention, may be easily applied to an EL display device of a form of handling a digital image signal. FIG. 9 is a schematic view of an EL display device using a driver circuit having a latch circuit of the present invention. A pixel portion 906 is arranged in the center. The pixel portion is arranged with a current supply line 907 to supply current to the EL element. On the upper side of the pixel portion is arranged a source signal line driver circuit 901 for controlling a source signal line. The source signal line driver circuit 901 comprises a shift register circuit 903, a first latch circuit 904, a second latch circuit 905, and the like. The first latch circuit 904 has the structure as shown in FIG. 1. The other component parts are the same as in the conventional example. On the left and right of the pixel portion, gate signal line driver circuits 902 for controlling gate signal lines are arranged. Note that, in FIG. 9, the gate signal line driver circuits 902 are arranged on both the left and right sides of the pixel portion, but the circuit may be arranged on only one side. However, the arrangement on both sides is more preferable from the point of view of driving efficiency and driving reliability.

Figure 18:
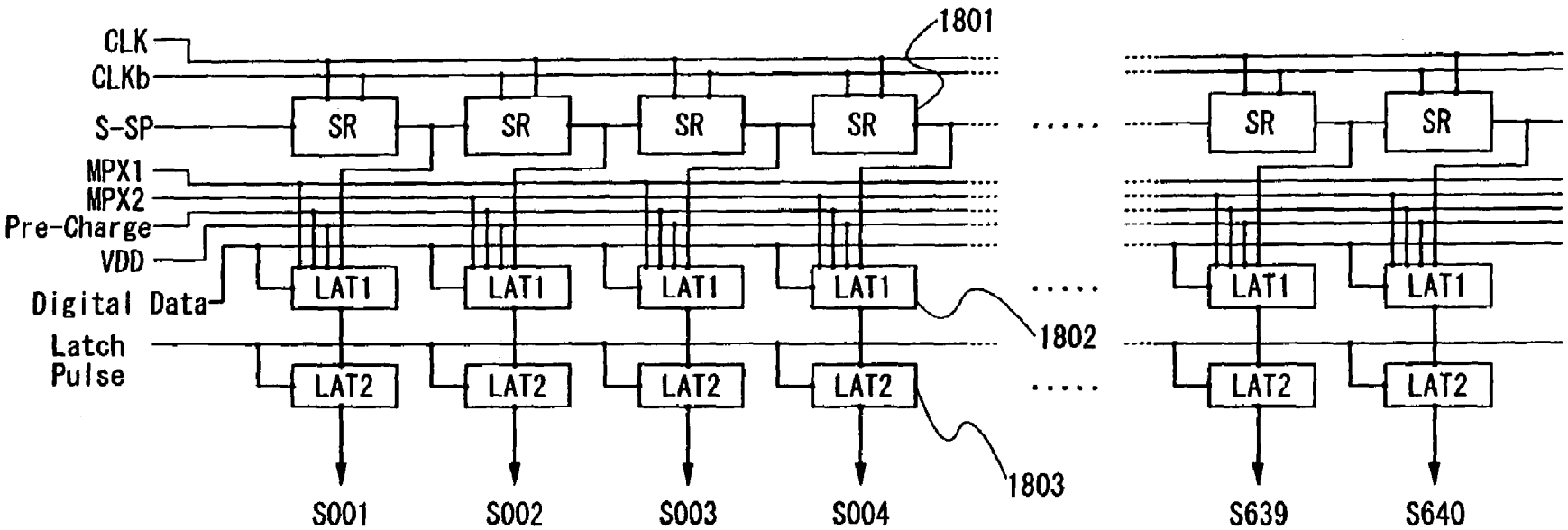
FIG. 18 is a diagram of a circuit structural example of the source signal line driver circuit of the EL display device.

The source signal line driver circuit of the EL display device shown in FIG. 9 has the structure as shown in FIG. 18. The operations of a shift register circuit 1801, a first latch circuit (LAT1) 1802 and a second latch circuit (LAT2) 1803 are the same as that of the source signal line driver circuit of the liquid crystal display device shown in Embodiment 1. In the case of the EL display device, the digital image signal held in the latch circuit is directly written in the pixel portion without performing D/A conversion.

FIG. 19 shows a method of performing multi gray-scale display in the EL display device. As an example, there is an EL display device with VGA and 4 bit gray-scale.

Figures 19A, 19B, 19C, 19D:
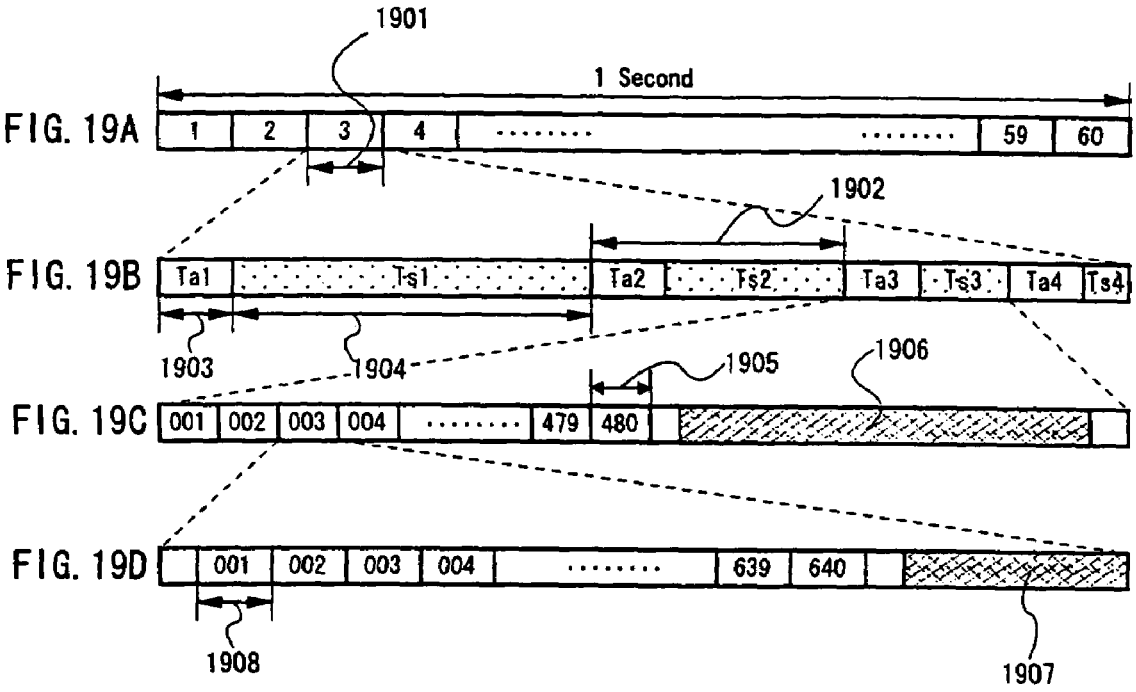
FIGS. 19A to 19D are diagrams of a timing chart to explain a time gray scale method in the EL display device.

When the image (it may be a still image or a moving image) is displayed, as shown in FIG. 19A, updating of the screen display is performed approximately 60 times in one second, and the display period for one screen shown by reference numeral 1901 is referred to as a one frame period. Since it is difficult for the EL element to perform display of luminance by using the analog amount signal, a time gray-scale method of performing expression of a gray scale using only the two conditions of digital ON and OFF is used as one of the display methods.

As shown in FIG. 19B, a one frame period is divided into a plurality of subframe periods. When performing n bit gray scale expression, the number of subframe periods becomes n. That is, in the case of FIG. 19B, expression of a 4 bit gray scale is possible. One subframe period 1902 has an address (write in) period 251903 and a sustain (light-up) period 1904 respectively, the address period is a period to perform writing in a pixel for one screen, and the lengths are equal in all periods of Ta1 to Ta4. On the other hand, in respect to the sustain period in the case of n bit gray scale display, the length is expressed as, Ts1:Ts2: . . . :Tsn=$2^n$: $2^{n-1}$ : . . . $2^0$, which shows a ratio of 2 squared. In the case of FIG. 19B, it becomes Ts1:Ts2:Ts3:Ts4=8:4:2:1. By combining the respective sustain periods, and using the difference of the lengths of the light-up time of the EL element, the gray scale display is performed. For example, in a 4 bit gray scale, where the darkest gray scale is 0 and the lightest gray scale is 15, when expressing the 11 gray scale, the EL elements are lighted in Ts1, Ts3 and Ts4. In this way, the sum of the light-up period becomes 8+2+1=11, and a difference in brightness between the gray scale of the 15 light-up time and the gray scale of the 11 light-up time may be made.

FIG. 19C shows one subframe period in detail. In the address period, the write in of a signal for one screen is sequentially performed for each gate signal line. The period shown by reference numeral 1905 is a one gate signal line selection period, and from the period where the first row gate signal line is selected and writing in of the signal is performed (the period shown by reference numeral 001 in FIG. 19C) to the period where the gate signal line of the final stage is selected and writing in of the signal is performed (the period shown as reference numeral 480 in FIG. 19C) is performed in the address period. Thereafter, as shown by reference numeral 1906, the sustain period is entered.

Further, FIG. 19D shows one gate signal line selection period in detail. One gate signal line selection period is separated into, a dot data sampling period holding the digital image signal in the first latch circuit and a line data latch period 1907 which transfers the digital image signal held in the first latch circuit to the second latch circuit. In the dot data sampling period, holding the writing in signal for each source signal line is subsequently performed from the first row (the period shown by reference numeral 001 in FIG. 19D) to the last row (the period shown by reference numeral 001 in FIG. 19D). The signal for one horizontal period is transferred all at once from the first latch circuit to the second latch circuit. In the EL display device, the image is displayed by the above method. In this way, in the EL display device, the driver circuit having the latch circuit of the present invention may easily be applied without especially changing the display method.

Embodiment 7

Figure 10A:
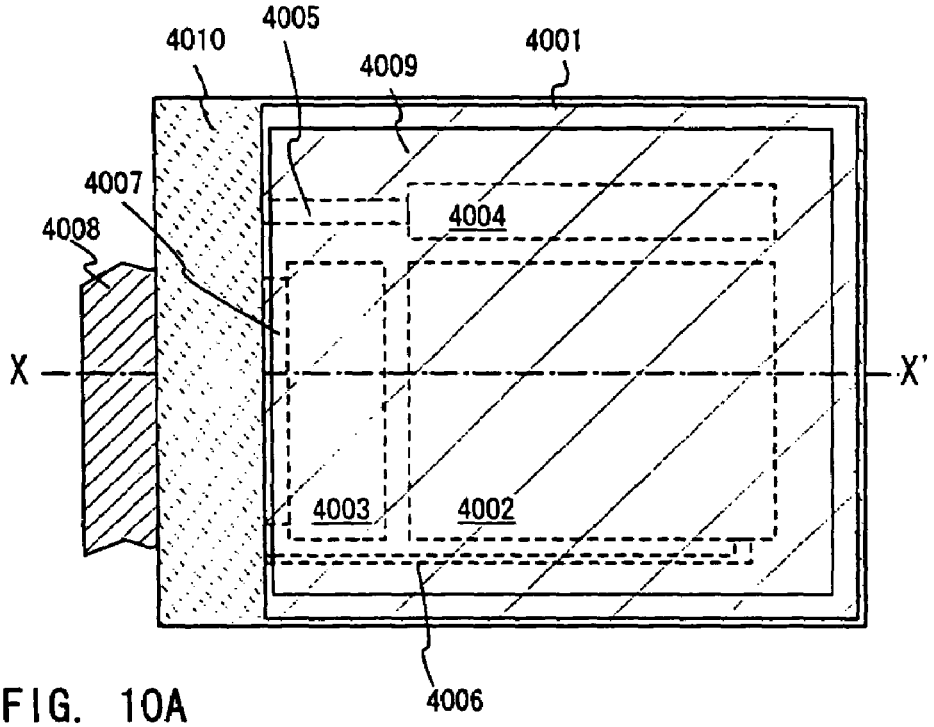
FIGS. 10A and 10B are a front view and a cross sectional view of the EL display device.
Figure 10B:
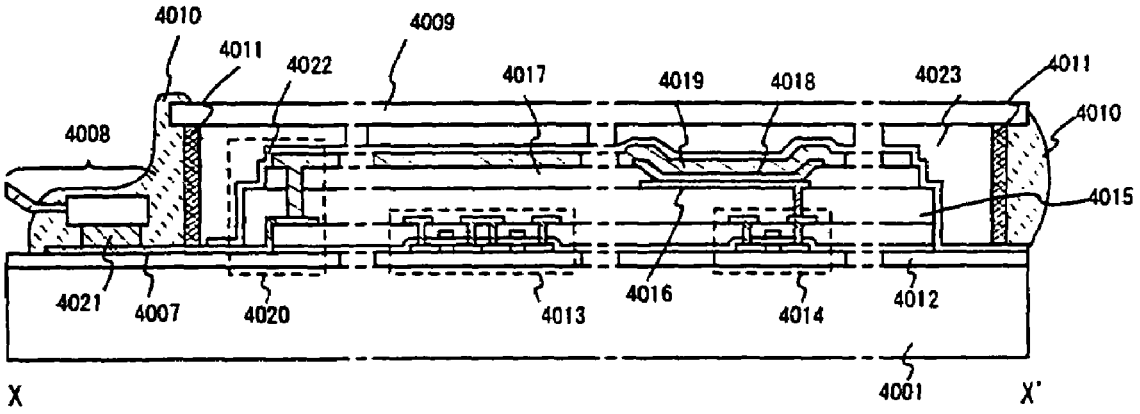
Figure 11:
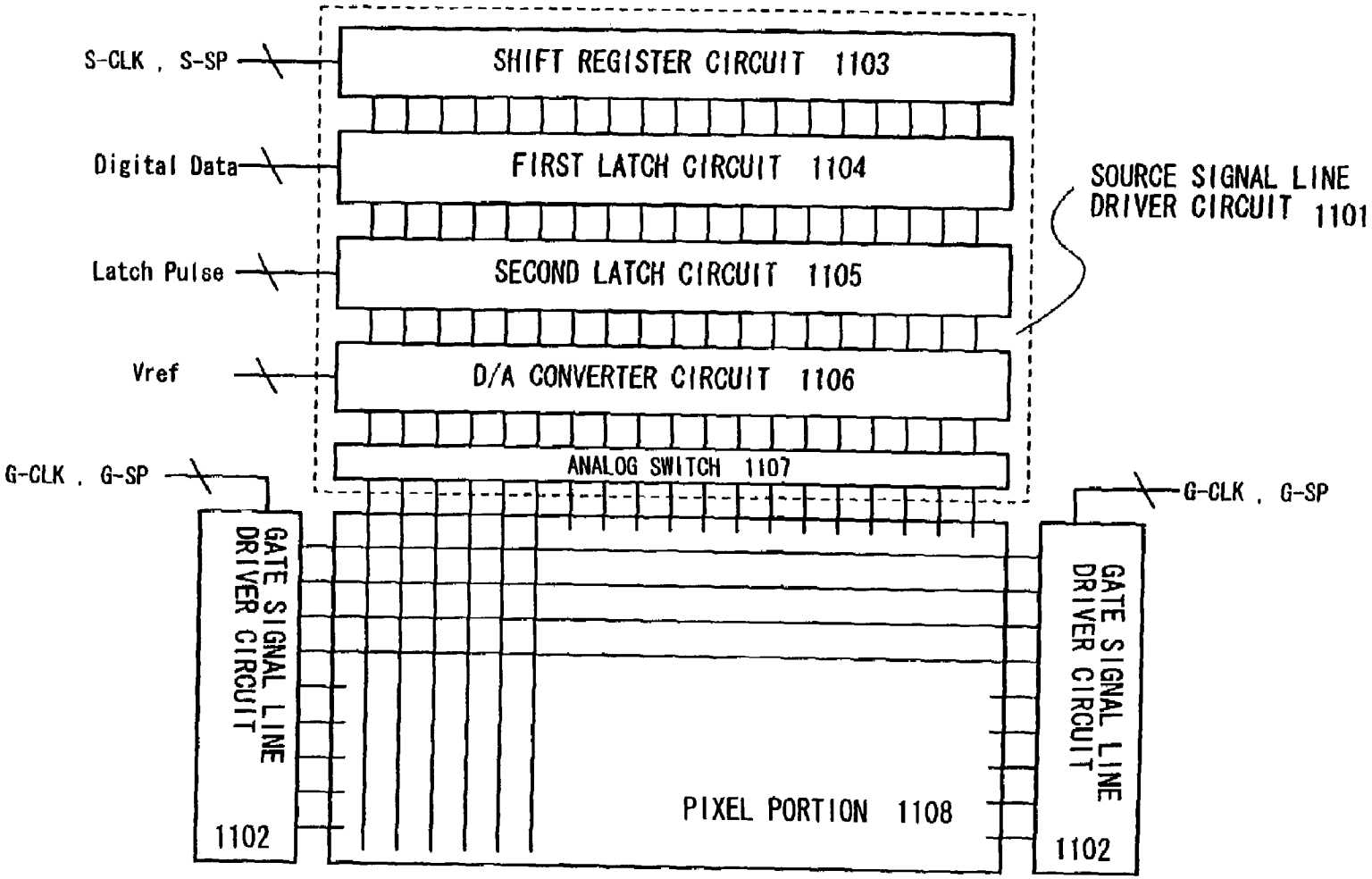
FIG. 11 is a schematic view of the entire conventional display device with a digital image signal input method.
Figure 12:
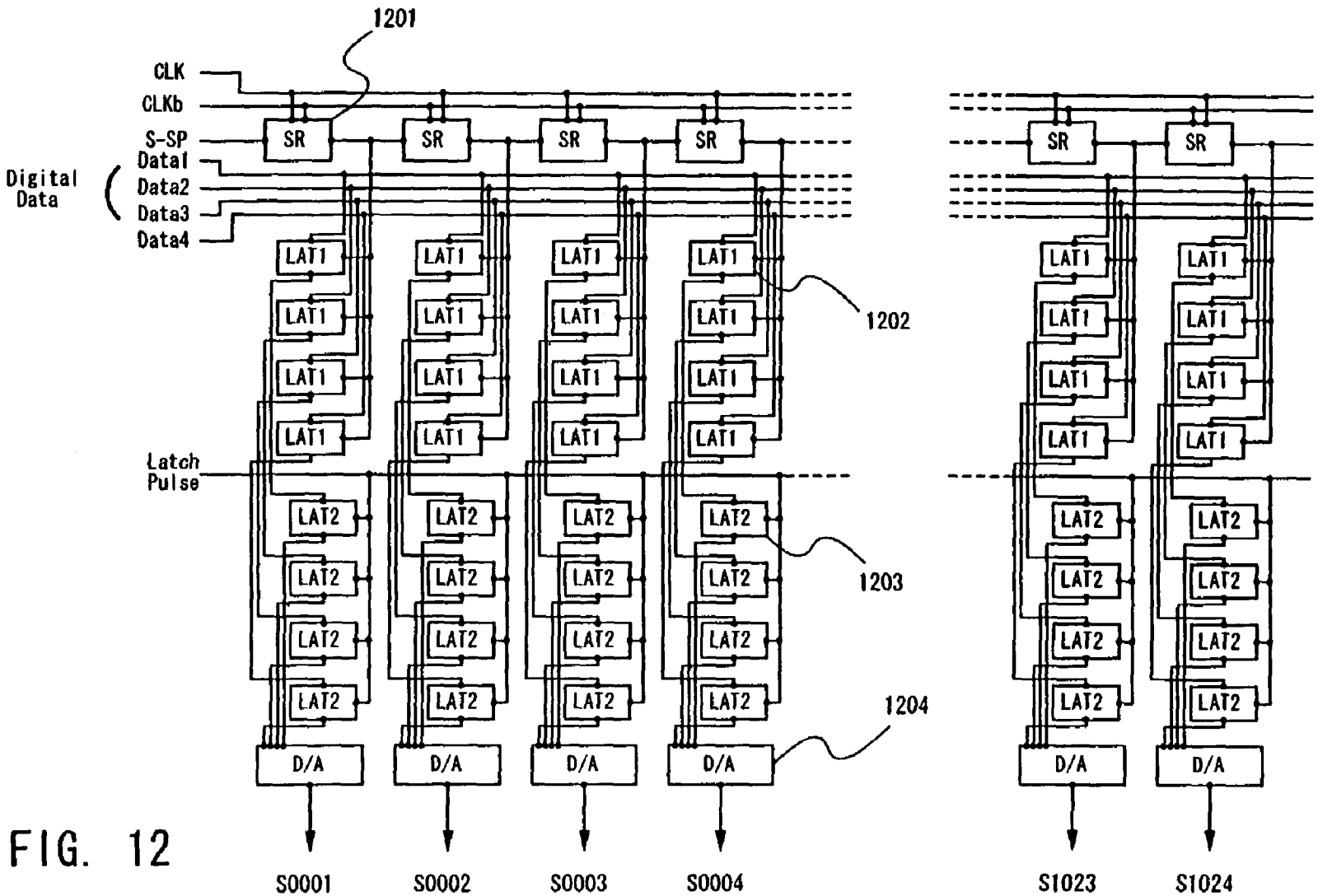
FIG. 12 is a diagram of a circuit structure of a source signal line driver circuit of the display device shown in FIG. 11.
Figure 13:
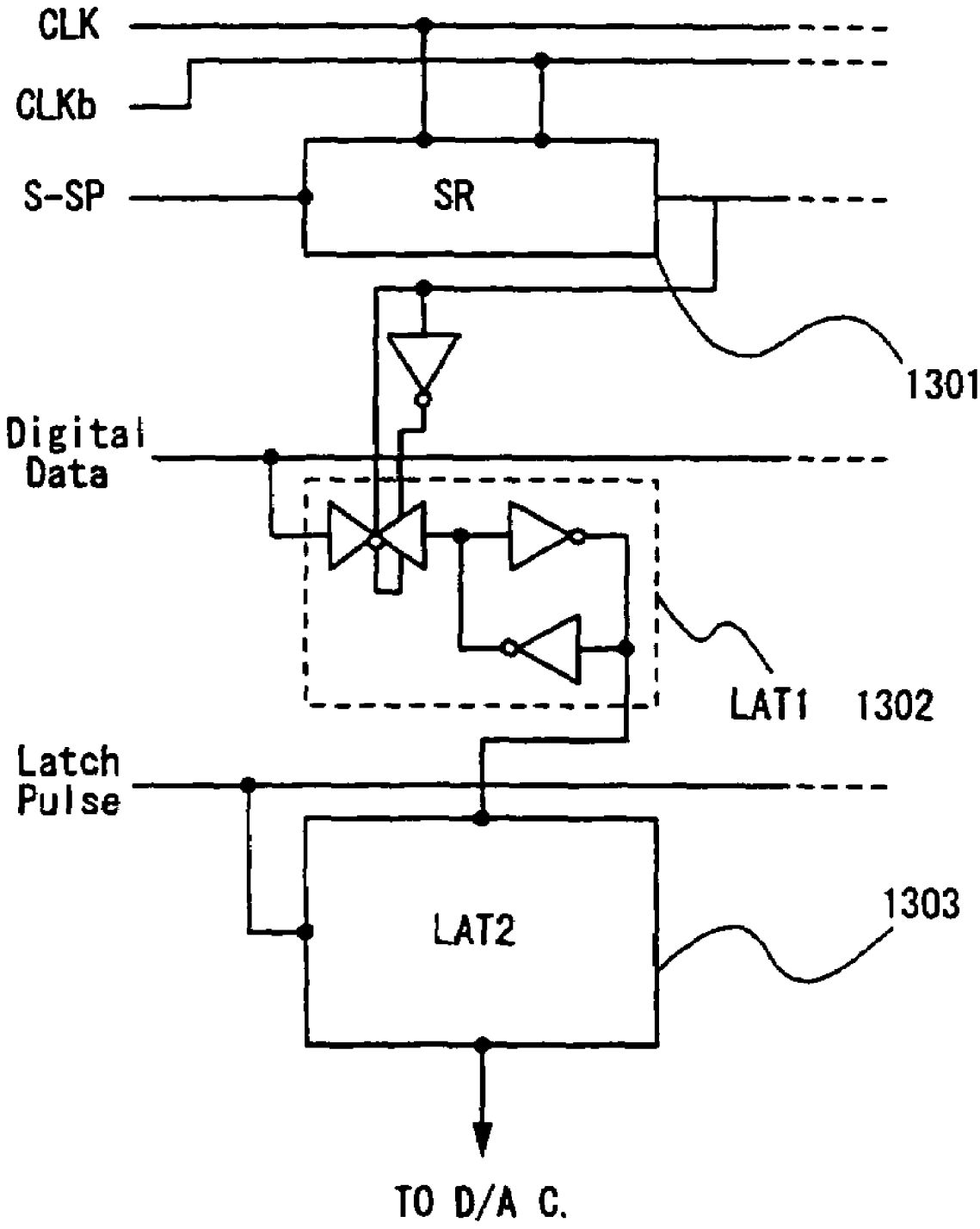
FIG. 13 is a diagram of a structure of the periphery of a conventional latch circuit.

FIG. 10A is a top view of an EL display device using the present invention. FIG. 10B is a cross-sectional view of FIG. 10A taken along the line X–X'. In FIG. 1A, reference numeral 4001 is a substrate, reference numeral 4002 is a pixel portion, reference numeral 4003 is a source signal line driver circuit, reference numeral 4004 is a writing gate signal line driver circuit and 4005 is an erasing gate signal line driver circuit. The driver circuits are connected to external equipment, through an FPC 4008, via wirings 4005, 4006 and 4007.

A covering material 4009, a sealing material 4010, and an airtight sealing material (also referred to as a housing material) 4011 are formed so as to enclose at least the pixel portion, preferably the driver circuits and the pixel portion, at this point.

Further, FIG. 10B is a cross-sectional structure of the EL display device of this embodiment. A driver circuit TFT 4013 (note that a CMOS circuit in which an n-channel TFT and a p-channel TFT are combined is shown in the figure here), a pixel portion TFT 4014 (note that only an EL driving TFT for controlling the current flowing to an EL element is shown here) are formed on a base film 4012 on a substrate 4001. The TFTs may be formed using a known structure (a top gate structure or a bottom gate structure).

After the driver circuit TFT 4013 and the pixel portion TFT 4014 are completed, a pixel electrode 4016 is formed on an interlayer insulating film (leveling film) 4015 made from a resin material. The pixel electrode is formed from a transparent conducting film for electrically connecting to a drain of the pixel TFT 4014. An indium oxide and tin oxide compound (referred to as ITO) or an indium oxide and zinc oxide compound can be used as the transparent conducting film. An insulating film 4017 is formed after forming the pixel electrode 4016, and an open portion is formed on the pixel electrode 4016.

An EL layer 4018 is formed next. The EL layer 4018 may be formed having a lamination structure, or a single layer structure, by freely combining known EL materials (such as a hole injecting layer, a hole transporting layer, a light emitting layer, an electron transporting layer, and an electron injecting layer). A known technique may be used to determine which structure to use. Further, EL materials exist as low molecular weight materials and high molecular weight (polymer) materials. Evaporation is used when using a low molecular weight material, but it is possible to use easy methods such as spin coating, printing, and ink jet printing when a high molecular weight material is employed.

In embodiment 7, the EL layer is formed by evaporation using a shadow mask. Color display becomes possible by forming emitting layers (a red color emitting layer, a green color emitting layer, and a blue color emitting layer), capable of emitting light having different wavelengths, for each pixel using a shadow mask. In addition, methods such as a method of combining a charge coupled layer (CCM) and color filters, and a method of combining a white color light emitting layer and color filters may also be used. Of course, the EL display device can also be made to emit a single color of light.

After forming the EL layer 4018, a cathode 4019 is formed on the EL layer. It is preferable to remove as much as possible any moisture or oxygen existing in the interface between the cathode 4019 and the EL layer 4018. It is therefore necessary to deposit the EL layer 4018 and the cathode 4019 under vacuum or to form the EL layer 4018 in an inert gas atmosphere and to form the cathode 4019 without an air exposure. The above film deposition becomes possible in embodiment 7 by using a multi-chamber method (cluster tool method) film deposition apparatus.

Note that a lamination structure of a LiF (lithium fluoride) film and an Al (aluminum) film is used in embodiment 7 as the cathode 4019. Specifically, a 1 nm thick LiF (lithium fluoride) film is formed by evaporation on the EL layer 4018, and a 300 nm thick aluminum film is formed on the LiF film. An MgAg electrode, a known cathode material, may of course also be used. The wiring 4007 is then connected to the cathode 4019 in a region denoted by reference numeral 4020. The wiring 4007 is an electric power supply line for imparting a predetermined voltage to the cathode 4019, and is connected to the FPC 4008 through a conducting paste material 4021.

In order to electrically connect the cathode 4019 and the wiring 4007 in the region denoted by reference numeral 4020, it is necessary to form a contact hole in the interlayer insulating film 4015 and the insulating film 4017. The contact holes may be formed at the time of etching the interlayer insulating film 4015 (when forming a contact hole for the pixel electrode) and at the time of etching the insulating film 4017 (when forming the opening portion before forming the EL layer). Further, when etching the insulating film 4017, etching may be performed all the way to the interlayer insulating film 4015 at one time. A good contact hole can be formed in this case, provided that the interlayer insulating film 4015 and the insulating film 4017 are the same resin material.

A passivation film 4022, a filling material 4023, and the covering material 4009 are formed covering the surface of the EL element thus made.

In addition, the sealing material 4011 is formed between the covering material 4009 and the substrate 4001, so as to surround the EL element portion, and the airtight sealing material (the second sealing material) 4010 is formed on the outside of the sealing material 4011.

The filling material 4023 functions as an adhesive for bonding the covering material 4009 at this point. PVC (polyvinyl chloride), epoxy resin, silicone resin, PVB (polyvinyl butyral), and EVA (ethylene vinyl acetate) can be used as the filling material 4023. If a drying agent is formed on the inside of the filling material 4023, then it can continue to maintain a moisture absorbing effect, which is preferable.

Further, spacers may be contained within the filling material 4023. The spacers may be a powdered substance such as BaO, giving the spacers themselves the ability to absorb moisture.

When using spacers, the passivation film 4022 can relieve the spacer pressure. Further, a film such as a resin film can be formed separately from the passivation film to relieve the spacer pressure.

Furthermore, a glass plate, an aluminum plate, a stainless steel plate, an FRP (fiberglass-reinforced plastic) plate, a PVF (polyvinyl fluoride) film, a Mylar film, a polyester film, and an acrylic film can be used as the covering material 4009. Note that if PVB or EVA is used as the filling material 4023, it is preferable to use a sheet with a structure in which several tens μm thick aluminum foil is sandwiched by a PVF film or a Mylar film.

However, depending upon the light emission direction from the EL device (the light radiation direction), it is necessary for the covering material 4009 to have light transmitting characteristics.

Further, the wiring 4007 is electrically connected to the FPC 4008 through a gap between the airtight sealing material 4010 and the substrate 4001. Note that although an explanation of the wiring 4007 has been made here, the wirings 4005, 4006 are also electrically connected to the FPC 4008 by similarly passing space between the airtight sealing material 4011 and sealing material 4010.

In this embodiment, the covering material 4009 is bonded after forming the filling material 4023, and the sealing material 4011 is attached so as to cover the lateral surfaces (exposed surfaces) of the filling material 4023, but the filling material 4023 may also be formed after attaching the covering material 4009 and the sealing material 4011. In this case, a filling material injection opening is formed through a gap formed by the substrate 4011, the covering material 4009, and the sealing material 4011. The gap is set into a vacuum state (a pressure equal to or less than $10^{-2}$ Torr), and after immersing the injection opening in the tank holding the filling material, the air pressure outside of the gap is made higher than the air pressure within the gap, and the filling material fills the gap.

Embodiment 8

Figure 17A:
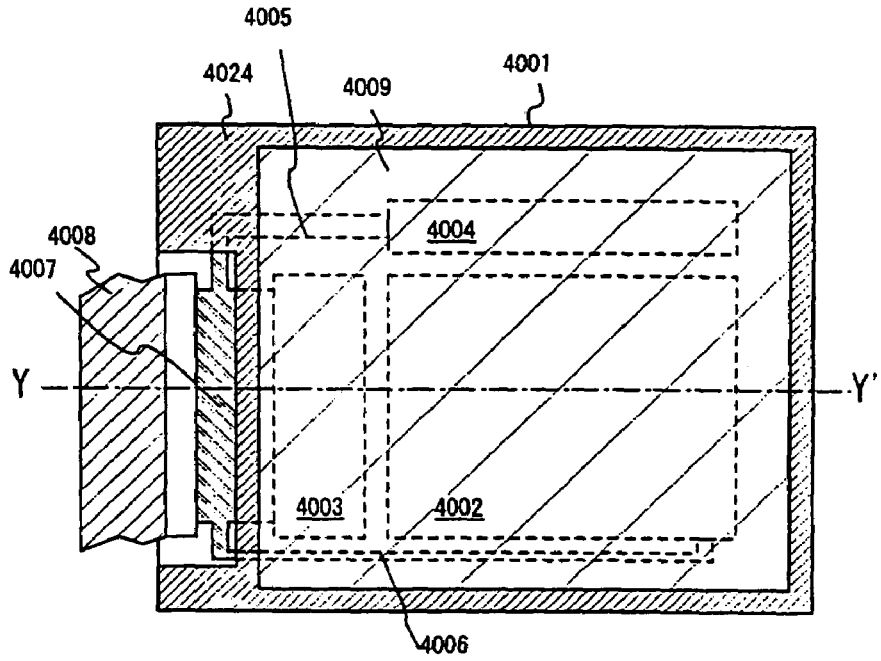
FIGS. 17A and 17B are a front view and a cross sectional view of the EL display device.
Figure 17B:
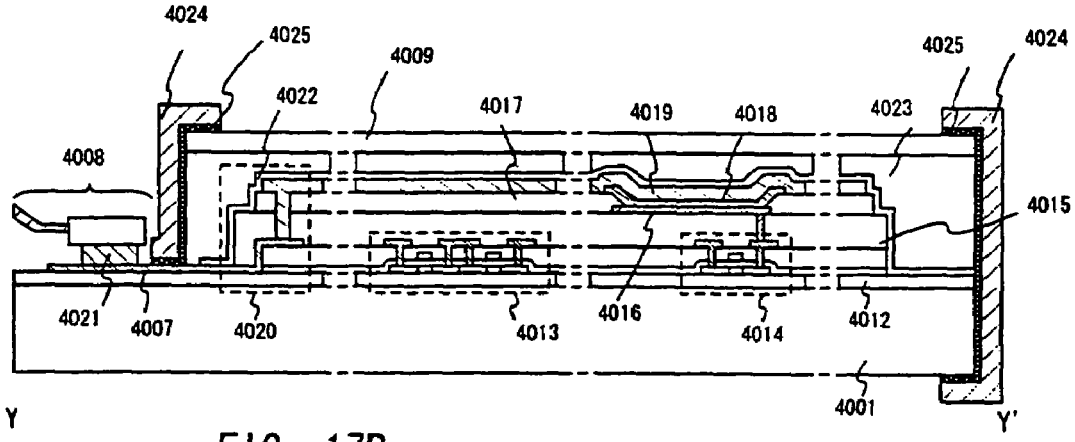

In this embodiment, an example of manufacturing an EL display device having a structure which differs from that of embodiment 7 is explained using FIGS. 17A and 17B. Parts having the same reference numerals as those of FIGS. 10A and 10B indicate the same portions, and therefore an explanation of those parts is omitted.

FIG. 17A is a top view of an EL display device of this embodiment, and FIG. 17B shows a cross sectional diagram in which FIG. 17A is cut along the line Y'Y'.

In accordance with embodiment 5, manufacturing is performed through the step of forming the passivation film 4022 covering the EL element.

In addition, the filling material 4023 is formed so as to cover the EL element. The filling material 4023 also functions as an adhesive for bonding the covering material 4009. PVC (polyvinyl chloride), epoxy resin, silicone resin, PVB (polyvinyl butyral), and EVA (ethylene vinyl acetate) can be used as the filling material 4023. If a drying agent is provided on the inside of the filling material 4023, then it can continue to maintain a moisture absorbing effect, which is preferable.

Further, spacers may be contained within the filling material 4023. The. spacers may be a powdered substance such as BaO, giving the spacers themselves the ability to absorb moisture.

When using spacers, the passivation film 4022 can relieve the spacer pressure. Further, a film such as a resin film can be formed separately from the passivation film 4022 to relieve the spacer pressure.

Furthermore, a glass plate, an aluminum plate, a stainless steel plate, an FRP (fiberglass-reinforced plastic) plate, a PVF (polyvinyl fluoride) film, a Mylar film, a polyester film, and an acrylic film can be used as the covering material 4009. Note that if PVB or EVA is used as the filler material 4023, it is preferable to use a sheet with a structure in which several tens μm thick aluminum foil is sandwiched by a PVF film or a Mylar film.

However, depending upon the light emission direction from the EL device (the light radiation direction), it is necessary for the covering material 4009 to have light transmitting characteristics.

After bonding the covering material 4009 using the filling material 4023, the frame material 4024 is attached so as to cover the lateral surfaces (exposed surfaces) of the filling material 4023. The frame material 4024 is bonded by the sealing material (which functions as an adhesive) 4025. It is preferable to use a light hardening resin as the sealing material 4025 at this point, but provided that the heat resistance characteristics of the EL layer permit, a thermal hardening resin may also be used. Note that it is preferable that the sealing material 4025 be a material which, as much as possible, does not transmit moisture and oxygen. Further, a drying agent may also be added to an inside portion of the sealing material 4025.

The wiring 4007 is electrically connected to the FPC 4008 through a gap between the sealing material 4025 and the substrate 4001. Note that although an explanation of the wiring 4008 has been made here, the wirings 4005 and 4006 are also electrically connected to the FPC 4008 by similarly passing through a gap between the sealing material 4025.

Note that the covering material 4009 is bonded, and the frame material 4024 is attached so as to cover the lateral surfaces (exposed surfaces) of the filling material 4023, after forming the filling material 4023 in this embodiment, but the filling material 4023 may also be formed after attaching the covering material 4009 and the frame material 4023. In this case, a filling material injection opening is formed through a gap formed by the substrate 4001, the covering material 4009, the sealing material 4025 and the frame material 4024. The gap is set into a vacuum state (a pressure equal to or less than $10^{-2}$ Torr), and after immersing the injection opening in the tank holding the filling material, the air pressure outside of the gap is made higher than the air pressure within the gap, and the filling material fills the gap.

Embodiment 9

An active matrix display device using the present invention has various usages. In this embodiment, a semiconductor device incorporated a display device using a driver circuit of the present invention is explained.

Such semiconductor devices include portable data terminals (electronic notebook, mobile computer, cell phone, etc.), video camera, still camera, personal computer, TV and projector. Their examples are shown in FIGS. 14, 15 and 16.

Figure 14A:
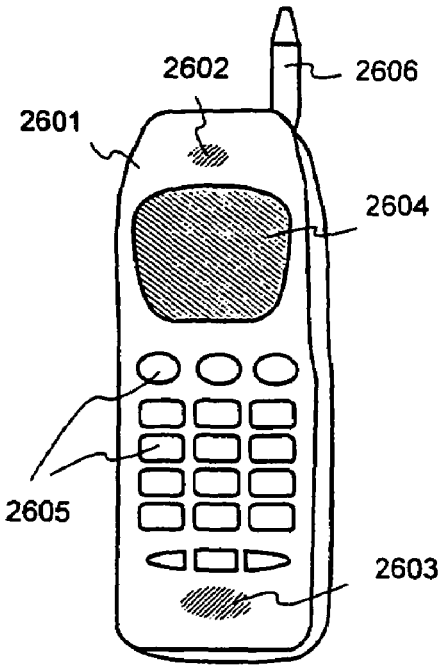
FIGS. 14A to 14F are diagrams of examples of electronic devices to which a driver circuit including the latch circuit of the present invention may be applied.

FIG. 14A shows a cell phone which comprises a main body 2601, a voice output unit 2602, a voice input unit 2603, a display portion 2604, an operation switch 2605 and a an antenna 2606. This invention can be applied to the display portion 2604.

Figure 14B:
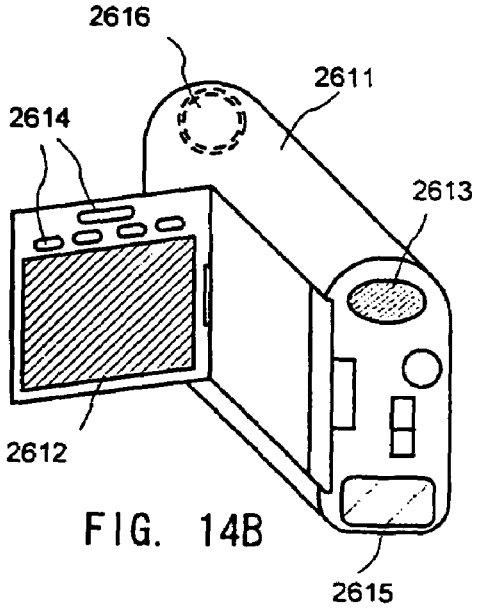

FIG. 14B shows a video camera which comprises a main body 2611, a display portion 2612, a voice input unit 2613, an operation panel 2614, a battery 2615 and an image receiving unit 2616. The invention can be applied to the display portion 2612.

Figure 14C:
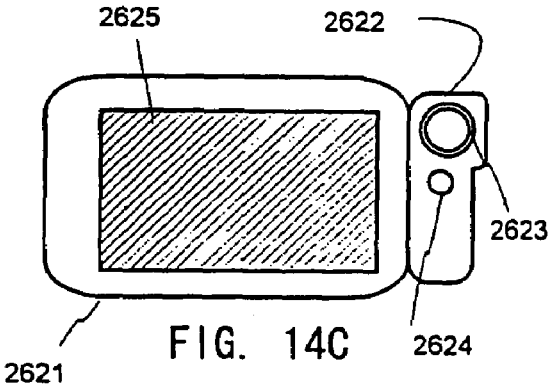

FIG. 14C shows a mobile computer or a portable data terminal which comprises a main body 2621, a camera unit 2622, an image receiving unit 2623, operation switches 2624 and a display portion 2625. The present invention can be applied to the display portion 2625.

Figure 14D:
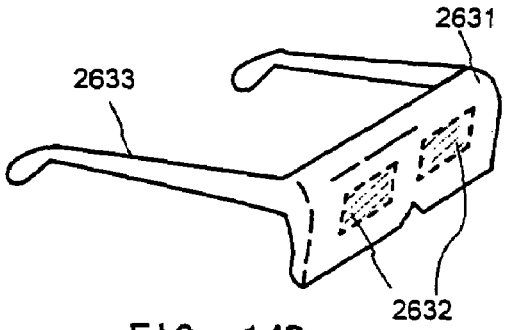

FIG. 14D shows head mounted display which comprises a main body 2631, a display portion 2632, an arm portion 2633. The present invention can be applied to the display portion 2632.

Figure 14E:
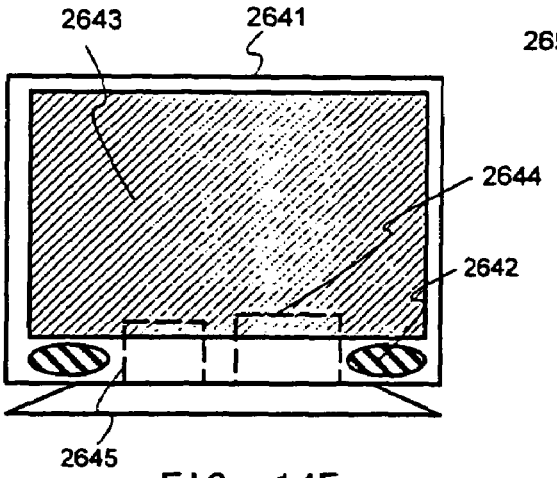

FIG. 14E shows a television which comprises a main body 2641, a speaker 2642, a receiver 2644 and an amplifier device 2641. The present invention can be applied to the display portion 2643.

Figure 14F:
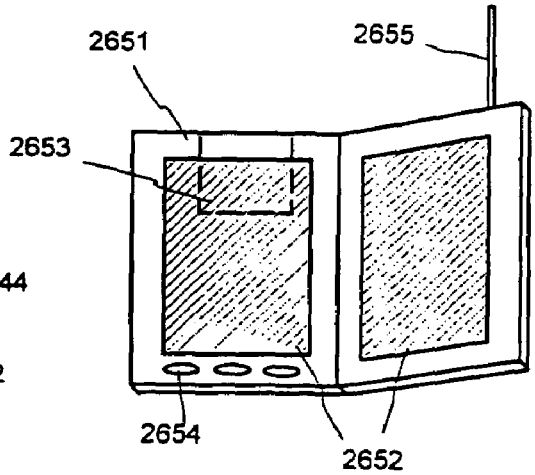

FIG. 14F shows a portable notebook which comprises a main body 2651, display devices 2652, a storage medium 2653, operation switches 2654 and an antenna 2655, which is used for displaying data stored in a mini-disk (MD) or in a DVD and for displaying data received by the antenna. The invention can be applied to the display device 2652.

Figure 15A:
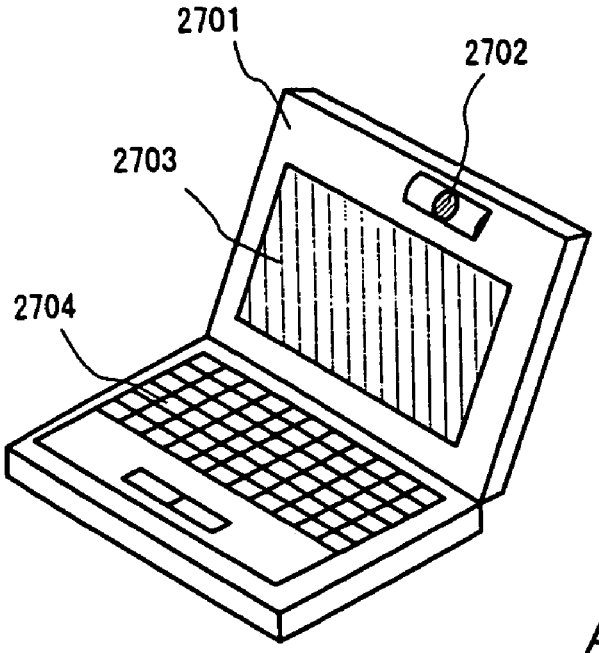
FIGS. 15A to 15D are diagrams of examples of the electronic devices to which the driver circuit including the latch circuit of the present invention may be applied.

FIG. 15A shows a personal computer which comprises a main body 2701, an image input unit 2702, a display device 2703 and a keyboard 2704. The invention can be applied to the display device 2703.

Figure 15B:
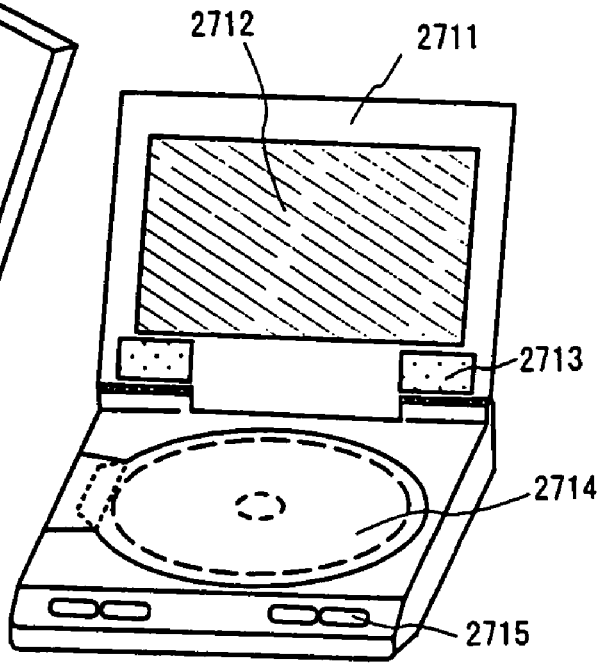

FIG. 15B shows a player using a recording medium recording a program which comprises a main body 2711, a display device 2712, a speaker unit 2713, a recording medium 2714 and operation switches 2715. This device uses a DVD (digital versatile disc) or a CD as a recording medium, with which the user can enjoy appreciating music, movies, or playing games or Internet. The invention can be applied to the display device 2612.

Figure 15C:
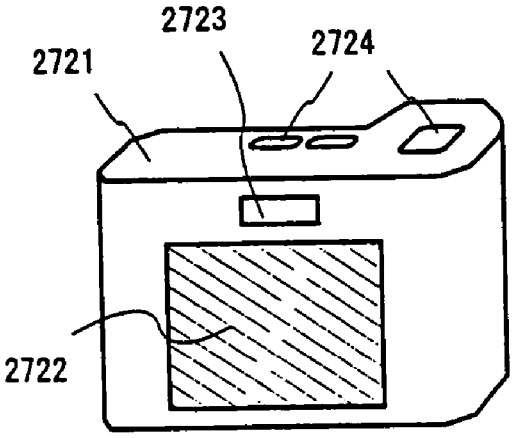

FIG. 15C shows a digital camera which comprises a main body 2721, a display portion 2722, an eyepiece unit 2723, operation switches 2724 and an image receiving unit (not shown). The invention can be applied to the display device 2722.

Figure 15D:
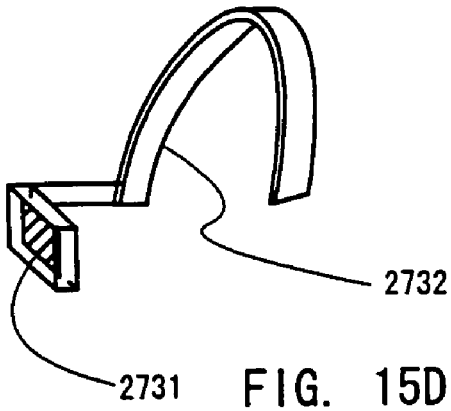

FIG. 15D shows a one-eyed head mounted display device which comprises a display portion 2731 and a band portion 2732. The present invention can be applied to the display device 2731.

Figure 16A:
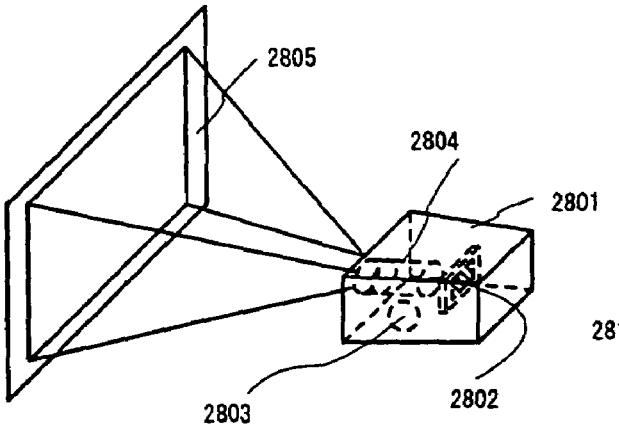
FIGS. 16A to 16D are diagrams of examples of the electron device to which the driver circuit including the latch circuit of the present invention may be applied.

FIG. 16A shows a front-type projector constituted by a main projector 2801, a display device 2802, a light source 2803, a light optical system 2804 and a screen 2805. A single-plate can be used to the projection device 2801 and also a third-plate corresponding to each light, R, G and B. The invention can be applied to the display device 2802.

Figure 16B:
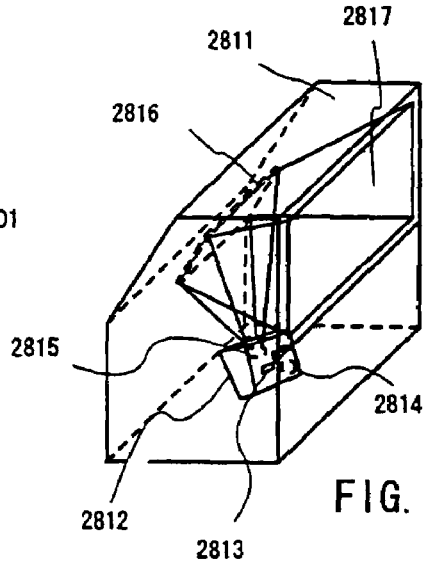

FIG. 16B shows a rear-type projector constituted by a main body 2811, a main projector 2812, a display device 2813, a light source 2814, a light optical system 2815, a reflector 2816 and a screen 2817. A single-plate can be used to the projection device 2813 and also a third-plate corresponding to each light, R, G and B. The invention can be applied to the display device 2813.

Figure 16C:
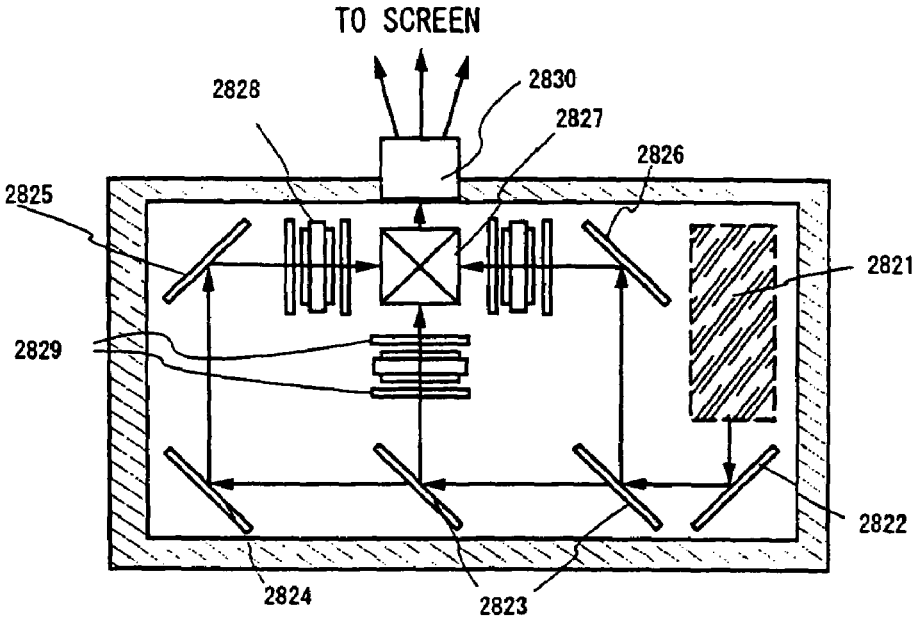

FIG. 16C is a diagram illustrating structures of the projectors 2801 and 2812 in FIGS. 16A and 16B. The projectors 2801,2812 are constituted by an optical system 2821 of a source of light, mirrors 2822, 2824 to 2826, a dichroic mirror 2823, a prism 2827, a display device 2828, a phase difference plate 2829 and a projection optical system 2830. The projection optical system 2830 is constituted by an optical system inclusive of a projection lens. Though this embodiment shows an example of the three-plate type, there may be employed the one of the single-plate type without being limited thereto. In the optical paths indicated by arrows in FIG. 16C, further, the user may suitably provide an optical system such as an optical lens, a film having a polarizing function, a film for adjusting the phase difference or an IR film.

Figure 16D:
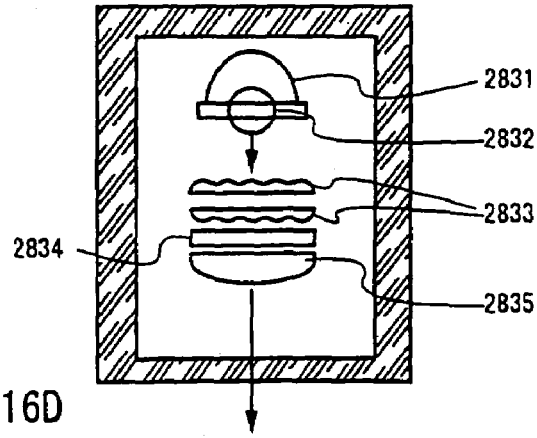

FIG. 16D is a diagram illustrating the structure of the optical system 2821 of the source of light in FIG. 16C. In this embodiment, the optical system 2821 of the source of light is constituted by a reflector 2831, a source of light 2832, lens array 2833, a polarizer/converter element 2834 and a focusing lens 2835. The optical system of the source of light shown in FIG. 16D is only an example, and is not particularly limited thereto only. For example, the user may suitably provide the optical system of the source of light with an optical system such as an optical lens, a film having a polarizing function, a film for adjusting the phase difference or an IR film.

By using the driver circuit having the latch circuit of the present invention as the display device, the problem around the conventional latch circuit, that is, the slight adjustment of the timing for each display device due to the image signal holding timing depending on the delay of signals output from the circuit does not have to be performed. By considering only the adjustment of signals input from the outside, the holding timing may be determined. In addition, since the driving frequency of the shift register circuit is ½, improvement of the reliability may be expected.

What is claimed is:

1. A personal computer comprising a display device having a driver circuit, said driver circuit comprising:

a holding circuit performing holding of a digital image signal which is input;

a pre-charge circuit provided between a signal input portion of the holding circuit and a first power supply; and a holding operation selection circuit provided between the signal input portion of the holding circuit and a digital image signal line, wherein the pre-charge circuit is input with a pre-charge signal, and wherein the holding operation selection circuit is input with a sampling pulse, a multiplex signal and a digital image signal.

2. A personal computer according to claim 1, wherein the pre-charge circuit, by the input of the pre-charge signal, makes the signal input portion of the holding portion and the first power supply in continuity, and wherein in the holding operation selection circuit, holding of the digital image signal is performed in the holding circuit, in a period where the input of the sampling pulse, the multiplex signal and the digital image signal overlap.

3. A personal computer according to claim 1, wherein the multiplex signal and the digital image signal are both directly input from the outside.

4. A personal computer according to claim 1, wherein a pulse width of the digital image signal and the pulse width of the multiplex signal are both smaller than the pulse width of the sampling pulse.

5. A personal computer according to claim 1, wherein the holding circuit comprises two inverters provided in a loop shape.

6. A personal computer according to claim 1, wherein the holding of the potential in the holding circuit is performed by a holding capacity.

7. A personal computer comprising a display device having a driver circuit, said driver circuit comprising:

a holding circuit performing holding of a digital image signal which is input;

a first transistor provided between a first power supply and a signal input portion of the holding circuit; and second, third and fourth transistors provided serially between a second power supply and the signal input portion of the holding circuit, wherein a gate electrode of the first transistor is input with a pre-charge signal, a gate electrode of the second transistor is input with a multiplex signal, a gate electrode of the third transistor is input with a digital image signal, and a gate electrode of the fourth transistor is input with a sampling pulse.

8. A personal computer according to claim 7, wherein the holding circuit performs holding of the digital image signal in a period where the input of the multiplex signal, the digital image signal and the sampling pulse overlap.

9. A personal computer according to claim 7, wherein the first transistor is in continuity by the input of the pre-charge signal, and a potential of the signal input portion of the holding circuit takes a first power supply potential, wherein the multiplex signal and the digital image signal are input during the period that the sampling pulse is output, the second to fourth transistors are in continuity, and the potential in the signal input portion of the holding circuit changes to a second power supply potential, and wherein thereafter, until the next return line period, the second power supply potential is held in the holding circuit.

10. A personal computer according to claim 7, wherein the multiplex signal and the digital image signal are both directly input from the outside.

11. A personal computer according to claim 7, wherein a pulse width of the digital image signal and the pulse width of the multiplex signal are both smaller than the pulse width of the sampling pulse.

12. A personal computer according to claim 7, wherein the holding circuit comprises two inverters provided in a loop shape.

13. A personal computer according to claim 7, wherein the holding of the potential in the holding circuit is performed by a holding capacity.

14. A personal computer comprising a display device having a driver circuit, said driver circuit comprising:

a holding circuit performing holding of a digital image signal which is input;

first and second transistors arranged in parallel between a first power supply and a signal input portion of the holding circuit; and third, fourth and fifth transistors arranged serially between a second power supply and the signal input portion of the holding circuit, wherein:

a gate electrode of the first transistor is input with a pre-charge signal;

a gate electrode of the second transistor is applied with a second power supply potential;

a gate electrode of the third transistor is input with a multiplex signal;

a gate electrode of the fourth transistor is input with a digital image signal; and a gate electrode of the fifth transistor is input with a sampling pulse.

15. A personal computer according to claim 14 further comprising a holding circuit performs holding of the digital image signal in a period where the input of the multiplex signal, the digital image signal and the sampling pulse overlap.

16. A personal computer according to claim 14, wherein:

the first transistor is in continuity by the input of the pre-charge signal, the potential in the signal input portion of the holding circuit takes a first power supply potential;

the multiplex signal and the digital image signal are input during the period that the sampling pulse is output, the third to fifth transistors are in continuity, and the potential in the signal input portion of the holding circuit changes to the second power supply potential; and thereafter, until the next return line period, the second power supply potential is held in the holding circuit.

17. A personal computer according to claim 14, wherein the multiplex signal and the digital image signal are both directly input from the outside.

18. A personal computer according to claim 14, wherein a pulse width of the digital image signal and the pulse width of the multiplex signal are both smaller than the pulse width of the sampling pulse.

19. A personal computer according to claim 14, wherein the holding circuit comprises two inverters provided in a loop shape.

20. A personal computer according to claim 14, wherein the holding of the potential in the holding circuit is performed by a holding capacity.

21. A personal computer comprising a display device having a driver circuit, said driver circuit comprising:

a holding circuit performing holding of a digital image signal which is input;

a NAND circuit; and an analog switch, wherein the NAND circuit is input with a sampling pulse and a multiplex signal, wherein the holding circuit is input with a digital image signal through the analog switch, wherein the continuity and non-continuity of the analog switch is controlled by an output of the NAND circuit, wherein a write in of the image signal to the holding circuit is performed with the continuity of the analog switch, and wherein thereafter, until the next return line period, the image signal is held in the holding circuit.

22. A personal computer according to claim 21, wherein the multiplex signal and the digital image signal are both directly input from the outside.

23. A personal computer according to claim 21, wherein a pulse width of the digital image signal and the pulse width of the multiplex signal are both smaller than the pulse width of the sampling pulse.

24. A personal computer according to claim 21, wherein the holding circuit comprises two inverters provided in a loop shape.

25. A personal computer according to claim 21, wherein the holding of the potential in the holding circuit is performed by a holding capacity.

26. A cellular phone comprising a display device having a driver circuit, said driver circuit comprising:

a holding circuit performing holding of a digital image signal which is input;

a pre-charge circuit provided between a signal input portion of the holding circuit and a first power supply; and a holding operation selection circuit provided between the signal input portion of the holding circuit and a digital image signal line, wherein the pre-charge circuit is input with a pre-charge signal, and wherein the holding operation selection circuit is input with a sampling pulse, a multiplex signal and a digital image signal.

27. A cellular phone according to claim 26, wherein the pre-charge circuit, by the input of the pre-charge signal, makes the signal input portion of the holding portion and the first power supply in continuity, and wherein in the holding operation selection circuit, holding of the digital image signal is performed in the holding circuit, in a period where the input of the sampling pulse, the multiplex signal and the digital image signal overlap.

28. A cellular phone according to claim 26, wherein the multiplex signal and the digital image signal are both directly input from the outside.

29. A cellular phone according to claim 26, wherein a pulse width of the digital image signal and the pulse width of the multiplex signal are both smaller than the pulse width of the sampling pulse.

30. A cellular phone according to claim 26, wherein the holding circuit comprises two inverters provided in a loop shape.

31. A cellular phone according to claim 26, wherein the holding of the potential in the holding circuit is performed by a holding capacity.

32. A cellular phone comprising a display device having a driver circuit, said driver circuit comprising:

a holding circuit performing holding of a digital image signal which is input;

a first transistor provided between a first power supply and a signal input portion of the holding circuit; and second, third and fourth transistors provided serially between a second power supply and the signal input portion of the holding circuit, wherein a gate electrode of the first transistor is input with a pre-charge signal, a gate electrode of the second transistor is input with a multiplex signal, a gate electrode of the third transistor is input with a digital image signal, and a gate electrode of the fourth transistor is input with a sampling pulse.

33. A cellular phone according to claim 32, wherein the holding circuit performs holding of the digital image signal in a period where the input of the multiplex signal, the digital image signal and the sampling pulse overlap.

34. A cellular phone according to claim 32, wherein the first transistor is in continuity by the input of the pre-charge signal, and a potential of the signal input portion of the holding circuit takes a first power supply potential, wherein the multiplex signal and the digital image signal are input during the period that the sampling pulse is output, the second to fourth transistors are in continuity, and the potential in the signal input portion of the holding circuit changes to a second power supply potential, and wherein thereafter, until the next return line period, the second power supply potential is held in the holding circuit.

35. A cellular phone according to claim 32, wherein the multiplex signal and the digital image signal are both directly input from the outside.

36. A cellular phone according to claim 32, wherein a pulse width of the digital image signal and the pulse width of the multiplex signal are both smaller than the pulse width of the sampling pulse.

37. A cellular phone according to claim 32, wherein the holding circuit comprises two inverters provided in a loop shape.

38. A cellular phone according to claim 32, wherein the holding of the potential in the holding circuit is performed by a holding capacity.

39. A cellular phone comprising a display device having a driver circuit, said driver circuit comprising:

a holding circuit performing holding of a digital image signal which is input;

first and second transistors arranged in parallel between a first power supply and a signal input portion of the holding circuit; and third, fourth and fifth transistors arranged serially between a second power supply and the signal input portion of the holding circuit, wherein:

a gate electrode of the first transistor is input with a pre-charge signal;

a gate electrode of the second transistor is applied with a second power supply potential;

a gate electrode of the third transistor is input with a multiplex signal;

a gate electrode of the fourth transistor is input with a digital image signal; and a gate electrode of the fifth transistor is input with a sampling pulse.

40. A cellular phone according to claim 39 further comprising a holding circuit performs holding of the digital image signal in a period where the input of the multiplex signal, the digital image signal and the sampling pulse overlap.

41. A cellular phone according to claim 39, wherein:

the first transistor is in continuity by the input of the pre-charge signal, the potential in the signal input portion of the holding circuit takes a first power supply potential;

the multiplex signal and the digital image signal are input during the period that the sampling pulse is output, the third to fifth transistors are in continuity, and the potential in the signal input portion of the holding circuit changes to the second power supply potential; and thereafter, until the next return line period, the second power supply potential is held in the holding circuit.

42. A cellular phone according to claim 39, wherein the multiplex signal and the digital image signal are both directly input from the outside.

43. A cellular phone according to claim 39, wherein a pulse width of the digital image signal and the pulse width of the multiplex signal are both smaller than the pulse width of the sampling pulse.

44. A cellular phone according to claim 39, wherein the holding circuit comprises two inverters provided in a loop shape.

45. A cellular phone according to claim 39, wherein the holding of the potential in the holding circuit is performed by a holding capacity.

46. A cellular phone comprising a display device having a driver circuit, said driver circuit comprising:

a holding circuit performing holding of a digital image signal which is input;

a NAND circuit; and an analog switch, wherein the NAND circuit is input with a sampling pulse and a multiplex signal, wherein the holding circuit is input with a digital image signal through the analog switch, wherein the continuity and non-continuity of the analog switch is controlled by an output of the NAND circuit, wherein a write in of the image signal to the holding circuit is performed with the continuity of the analog switch, and wherein thereafter, until the next return line period, the image signal is held in the holding circuit.

47. A cellular phone according to claim 46, wherein the multiplex signal and the digital image signal are both directly input from the outside.

48. A cellular phone according to claim 46, wherein a pulse width of the digital image signal and the pulse width of the multiplex signal are both smaller than the pulse width of the sampling pulse.

49. A cellular phone according to claim 46, wherein the holding circuit comprises two inverters provided in a loop shape.

50. A cellular phone according to claim 46, wherein the holding of the potential in the holding circuit is performed by a holding capacity.

51. A camera comprising a display device having a driver circuit, said driver circuit comprising:

a holding circuit performing holding of a digital image signal which is input;

a pre-charge circuit provided between a signal input portion of the holding circuit and a first power supply; and a holding operation selection circuit provided between the signal input portion of the holding circuit and a digital image signal line, wherein the pre-charge circuit is input with a pre-charge signal, and wherein the holding operation selection circuit is input with a sampling pulse, a multiplex signal and a digital image signal.

52. A camera according to claim 51, wherein the pre-charge circuit, by the input of the pre-charge signal, makes the signal input portion of the holding portion and the first power supply in continuity, and wherein in the holding operation selection circuit, holding of the digital image signal is performed in the holding circuit, in a period where the input of the sampling pulse, the multiplex signal and the digital image signal overlap.

53. A camera according to claim 51, wherein the multiplex signal and the digital image signal are both directly input from the outside.

54. A camera according to claim 51, wherein a pulse width of the digital image signal and the pulse width of the multiplex signal are both smaller than the pulse width of the sampling pulse.

55. A camera according to claim 51, wherein the holding circuit comprises two inverters provided in a loop shape.

56. A camera according to claim 51, wherein the holding of the potential in the holding circuit is performed by a holding capacity.

57. A camera comprising a display device having a driver circuit, said driver circuit comprising:

a holding circuit performing holding of a digital image signal which is input;

a first transistor provided between a first power supply and a signal input portion of the holding circuit; and second, third and fourth transistors provided serially between a second power supply and the signal input portion of the holding circuit, wherein a gate electrode of the first transistor is input with a pre-charge signal, a gate electrode of the second transistor is input with a multiplex signal, a gate electrode of the third transistor is input with a digital image signal, and a gate electrode of the fourth transistor is input with a sampling pulse.

58. A camera according to claim 57, wherein the holding circuit performs holding of the digital image signal in a period where the input of the multiplex signal, the digital image signal and the sampling pulse overlap.

59. A camera according to claim 57, wherein the first transistor is in continuity by the input of the pre-charge signal, and a potential of the signal input portion of the holding circuit takes a first power supply potential, wherein the multiplex signal and the digital image signal are input during the period that the sampling pulse is output, the second to fourth transistors are in continuity, and the potential in the signal input portion of the holding circuit changes to a second power supply potential, and wherein thereafter, until the next return line period, the second power supply potential is held in the holding circuit.

60. A camera according to claim 57, wherein the multiplex signal and the digital image signal are both directly input from the outside.

61. A camera according to claim 57, wherein a pulse width of the digital image signal and the pulse width of the multiplex signal are both smaller than the pulse width of the sampling pulse.

62. A camera according to claim 57, wherein the holding circuit comprises two inverters provided in a loop shape.

63. A camera according to claim 57, wherein the holding of the potential in the holding circuit is performed by a holding capacity.

64. A camera comprising a display device having a driver circuit, said driver circuit comprising:

a holding circuit performing holding of a digital image signal which is input;

first and second transistors arranged in parallel between a first power supply and a signal input portion of the holding circuit; and third, fourth and fifth transistors arranged serially between a second power supply and the signal input portion of the holding circuit, wherein:

a gate electrode of the first transistor is input with a pre-charge signal;

a gate electrode of the second transistor is applied with a second power supply potential;

a gate electrode of the third transistor is input with a multiplex signal;

a gate electrode of the fourth transistor is input with a digital image signal; and a gate electrode of the fifth transistor is input with a sampling pulse.

65. A camera according to claim 64 further comprising a holding circuit performs holding of the digital image signal in a period where the input of the multiplex signal, the digital image signal and the sampling pulse overlap.

66. A camera according to claim 64, wherein:

the first transistor is in continuity by the input of the pre-charge signal, the potential in the signal input portion of the holding circuit takes a first power supply potential;

the multiplex signal and the digital image signal are input during the period that the sampling pulse is output, the third to fifth transistors are in continuity, and the potential in the signal input portion of the holding circuit changes to the second power supply potential; and thereafter, until the next return line period, the second power supply potential is held in the holding circuit.

67. A camera according to claim 64, wherein the multiplex signal and the digital image signal are both directly input from the outside.

68. A camera according to claim 64, wherein a pulse width of the digital image signal and the pulse width of the multiplex signal are both smaller than the pulse width of the sampling pulse.

69. A camera according to claim 64, wherein the holding circuit comprises two inverters provided in a loop shape.

70. A camera according to claim 64, wherein the holding of the potential in the holding circuit is performed by a holding capacity.

71. A camera comprising a display device having a driver circuit, said driver circuit comprising:

a holding circuit performing holding of a digital image signal which is input;

a NAND circuit; and an analog switch, wherein the NAND circuit is input with a sampling pulse and a multiplex signal, wherein the holding circuit is input with a digital image signal through the analog switch, wherein the continuity and non-continuity of the analog switch is controlled by an output of the NAND circuit, wherein a write in of the image signal to the holding circuit is performed with the continuity of the analog switch, and wherein thereafter, until the next return line period, the image signal is held in the holding circuit.

72. A camera according to claim 71, wherein the multiplex signal and the digital image signal are both directly input from the outside.

73. A camera according to claim 71, wherein a pulse width of the digital image signal and the pulse width of the multiplex signal are both smaller than the pulse width of the sampling pulse.

74. A camera according to claim 71, wherein the holding circuit comprises two inverters provided in a loop shape.

75. A camera according to claim 71, wherein the holding of the potential in the holding circuit is performed by a holding capacity.

* * * * *